US011780620B2

(12) United States Patent
Hattori et al.

(10) Patent No.: US 11,780,620 B2
(45) Date of Patent: Oct. 10, 2023

(54) REBAR TYING MACHINE

(71) Applicant: MAKITA CORPORATION, Anjo (JP)

(72) Inventors: Hitomi Hattori, Anjo (JP); Yuta Asakura, Anjo (JP); Shunta Mizuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 89 days.

(21) Appl. No.: 17/584,050

(22) Filed: Jan. 25, 2022

(65) Prior Publication Data

US 2022/0267038 A1 Aug. 25, 2022

(30) Foreign Application Priority Data

Feb. 25, 2021 (JP) ..... 2021-029232

(51) Int. Cl.
*B65B 13/02* (2006.01)

(52) U.S. Cl.
CPC ..... *B65B 13/027* (2013.01)

(58) Field of Classification Search
CPC ..... B21F 15/00; B21F 15/02; B21F 15/04; B65B 13/22; B65B 13/28; B65B 13/285; B65B 13/025; B25B 25/00; E04G 21/123
See application file for complete search history.

(56) References Cited

U.S. PATENT DOCUMENTS

| | | | | |
|---|---|---|---|---|
| 6,401,766 | B1 | 6/2002 | Ishikawa et al. | |
| 7,275,567 | B2 | 10/2007 | Ishii et al. | |
| 11,571,733 | B2 * | 2/2023 | Yoshida | B65B 27/10 |
| 2005/0005992 | A1 * | 1/2005 | Kusakari | B21F 15/06 140/119 |
| 2017/0174374 | A1 * | 6/2017 | Figiel | B65B 57/00 |

FOREIGN PATENT DOCUMENTS

JP 2001-140471 A 5/2001

* cited by examiner

*Primary Examiner* — Bobby Yeonjin Kim
(74) *Attorney, Agent, or Firm* — Oliff PLC

(57) ABSTRACT

The disclosure herein discloses a rebar tying machine. The rebar tying machine may include a feed motor, a current sensor configured to detect a current flowing through the feed motor, and a control unit configured to control an operation of the feed motor. The rebar tying machine may be configured to perform: a feeding-out process in which a wire is fed out around rebars by driving the feed motor, a gripping process in which a vicinity of a tip of the wire is gripped, a pulling-back process in which the wire is pulled back by driving the feed motor, a cutting process in which the wire is cut, and a twisting process in which the wire is twisted. The control unit may be configured to determine a diameter of the rebars based on a history of a current value flowing through the feed motor in the pulling-back process.

8 Claims, 28 Drawing Sheets

REBAR TYING MACHINE

CROSS-REFERENCE TO RELATED APPLICATION

This application claims priority to Japanese Patent Application No. 2021-029232, filed on Feb. 25, 2021, the entire contents of which are incorporated herein by reference.

TECHNICAL FIELD

The technique disclosed herein relates to rebar tying machines.

BACKGROUND

Japanese Patent Application Publication No. 2001-140471 describes a rebar tying machine. The rebar tying machine incudes a feed motor, a current sensor configured to detect a current flowing through the feed motor, a control unit configured to control an operation of the feed motor, and a determination mechanism configured to determine the diameter of rebars. The rebar tying machine is configured to perform a feeding-out process in which a wire is fed out around the rebars by driving the feed motor, a cutting process in which the wire is cut, and a twisting process in which the wire is twisted. The rebar tying machine operates depending on the diameter of the rebars determined by the determination mechanism.

SUMMARY

The rebar tying machine above requires the determination mechanism for determining the diameter of the rebars and thus has a complex mechanical configuration. The disclosure herein provides techniques that enable a rebar tying machine to operate depending on a diameter of rebars without a determination mechanism for determining the diameter of the rebars.

The disclosure herein discloses a rebar tying machine. The rebar tying machine may comprise a feed motor, a current sensor configured to detect a current flowing through the feed motor, and a control unit configured to control an operation of the feed motor. The rebar tying machine may be configured to perform a feeding-out process in which a wire is fed out around rebars by driving the feed motor, a gripping process in which a vicinity of a tip of the wire is gripped, a pulling-back process in which the wire is pulled back by driving the feed motor, a cutting process in which the wire is cut, and a twisting process in which the wire is twisted. The control unit may be configured to determine a diameter of the rebars based on a history of a current value flowing through the feed motor in the pulling-back process.

The disclosure herein also discloses another rebar tying machine. The rebar tying machine may comprise a feed motor, a current sensor configured to detect a current flowing through the feed motor, and a control unit configured to control an operation of the feed motor. The rebar tying machine may be configured to perform a feeding-out process in which a wire is fed out around rebars by driving the feed motor, a gripping process in which a vicinity of a tip of the wire is gripped, a pulling-back process in which the wire is pulled back by driving the feed motor, a cutting process in which the wire is cut, and a twisting process in which the wire is twisted. The control unit may be configured to, in the pulling-back process, stop the feed motor when a stop condition is satisfied. The control unit may be configured to change the stop condition according to a history of a current value flowing through the feed motor in the pulling-back process.

DETAILED DESCRIPTION

Figure 1:
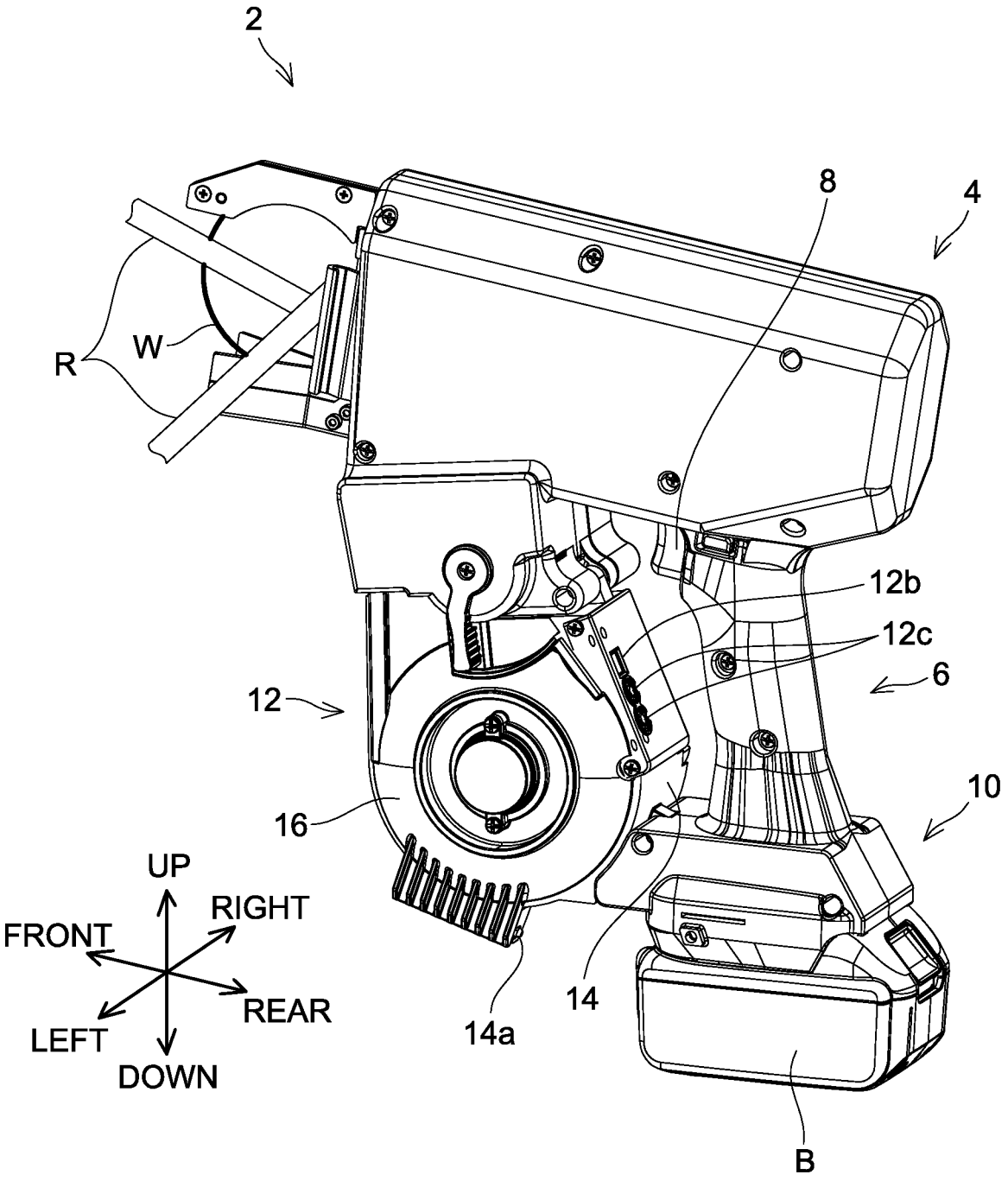
FIG. 1 is a perspective view of a rebar tying machine 2 according to an embodiment.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved rebar tying machines, as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a rebar tying machine may comprise a feed motor, a current sensor configured to detect a current flowing through the feed motor, and a control unit configured to control an operation of the feed motor. The rebar tying machine may be configured to perform a feeding-out process in which a wire is fed out around rebars by driving the feed motor, a gripping process in which a vicinity of a tip of the wire is gripped, a pulling-back process in which the wire is pulled back by driving the feed motor, a cutting process in which the wire is cut, and a twisting process in which the wire is twisted. The control unit may be configured to determine a diameter of the rebars based on a history of a current value flowing through the feed motor in the pulling-back process.

In the pulling-back process, the diameter of a loop formed by the wire fed around the rebars is reduced and the wire is appressed to the rebars. During this time, the behavior of the current value flowing through the feed motor changes at a timing when the wire starts to be appressed to the rebars and a timing when the wire is completely appressed to the rebars. As the diameter of the rebars is larger, the timing when the wire starts to be appressed to the rebars and the timing when the wire is completely appressed to the rebars come earlier. To the contrary, as the diameter of the rebars is smaller, the timing when the wire starts to be appressed to the rebars and the timing when the wire is completely appressed to the rebars come later. In the rebar tying machine above, the diameter of the rebars is determined based on the history of the current value flowing through the feed motor, taking advantage of the fact that the current value flowing through the feed motor in the pulling-back process exhibits different behaviors depending on the diameter of the rebars. Thus, the rebar tying machine can operate in accordance with the diameter of the rebars without a determination mechanism for determining the diameter of the rebars.

In one or more embodiments, the control unit may be configured to, in the pulling-back process, calculate a time rate of change of the current value flowing through the feed motor after an inrush current of the feed motor has peaked, and determine the diameter of the rebars based on a timing at which the time rate of change reaches a time rate of change threshold value.

In the pulling-back process, the current value flowing through the feed motor gradually decreases after the inrush current has peaked. Then, the current value flowing through the feed motor stops decreasing and starts to increase at the timing when the wire starts to be appressed to the rebars, and then stops to increase and starts decreasing again at the timing when the wire is completely appressed to the rebars. According to the configuration above, the diameter of the rebars can be determined at the timing when the current value flowing through the feed motor stops decreasing and starts to increase after the inrush current has peaked, namely at the timing when the wire starts to be appressed to the rebars. Thus, the rebar tying machine can perform the latter half of the pulling-back process in accordance with the determined diameter of the rebars.

In one or more embodiments, the control unit may be configured to, in the pulling-back process, stop the feed motor when a stop condition is satisfied. The control unit may be configured to change the stop condition according to the determined diameter of the rebars.

As the diameter of the rebar is larger, the timing when the wire starts to be appressed to the rebars comes earlier, and thus the feed motor needs to be stopped earlier accordingly. To the contrary, as the diameter of the rebars is smaller, the timing when the wire is completely appressed to the rebars comes later, and thus the feed motor needs to be stopped later accordingly. According to the configuration above, the feed motor can be stopped at an appropriate timing since the stop condition is changed according to the determined diameter of the rebars.

In one or more embodiments, the control unit may be configured to, in the pulling-back process, determine a minimum value of the current value flowing through the feed motor after the inrush current of the feed motor has peaked, and calculate an increase in the current value flowing through the feed motor from the minimum value. The stop condition may include that the increase reaches an increase threshold value. The control unit may be configured to change the increase threshold value according to the determined diameter of the rebars.

In the pulling-back process, as the diameter of the rebars is larger, the timing when the wire starts to be appressed to the rebar comes earlier, and thus the current value flowing through the feed motor does not decrease much after the inrush current has peaked. Therefore, the minimum value of the current value flowing through the feed motor after the inrush current has peaked is relatively large and an increase in the current value therefrom until the wire is completely appressed to the rebars is small. To the contrary, as the diameter of the rebars is smaller, the timing when the wire starts to be appressed to the rebars comes later, and thus the current value flowing through the feed motor significantly decreases after the inrush current has peaked. Therefore, the minimum value of the current value flowing through the feed motor after the inrush current has peaked is relatively small and an increase in the current value therefrom until the wire is completely appressed to the rebars is large. According to the configuration above, the increase threshold value is changed according to the determined diameter of the rebars, and thus the feed moto can be stopped at an appropriate timing.

In one or more embodiments, a rebar tying machine may comprise a feed motor, a current sensor configured to detect a current flowing through the feed motor, and a control unit configured to control an operation of the feed motor. The rebar tying machine may be configured to perform a feeding-out process in which a wire is fed out around rebars by driving the feed motor, a gripping process in which a vicinity of a tip of the wire is gripped, a pulling-back process in which the wire is pulled back by driving the feed motor, a cutting process in which the wire is cut, and a twisting process in which the wire is twisted. The control unit may be configured to, in the pulling-back process, stop the feed motor when a stop condition is satisfied. The control unit may be configured to change the stop condition according to a history of a current value flowing through the feed motor in the pulling-back process.

In the rebar tying machine above, the stop condition for the feed motor is changed based on the history of the current value flowing through the feed motor, taking advantage of the fact that the current value flowing through the feed motor in the pulling-back process exhibits different behaviors depending on the diameter of the rebars. Thus, the rebar tying machine can operate in accordance with the diameter of the rebars without a determination mechanism for determining the diameter of the rebars.

In one or more embodiments, the control unit may be configured to, in the pulling-back process, calculate a time rate of change of the current value flowing through the feed motor after an inrush current of the feed motor has peaked, and change the stop condition according to a timing at which the time rate of change reaches a time rate of change threshold value.

According to the configuration above, the stop condition for the feed motor can be changed at the timing when the current value flowing through the feed motor stops decreasing and starts to increase after the inrush current has peaked, namely at the timing when the wire starts to be appressed to the rebars.

In one or more embodiments, the control unit may be configured to, in the pulling-back process, determine a minimum value of the current value flowing through the feed motor after the inrush current of the feed motor has peaked, and calculate an increase in the current value flowing through the feed motor from the minimum value. The stop condition may include that the increase reaches an increase threshold value. The control unit may be configured to change the increase threshold value according to the timing at which the time rate of change reaches the time rate of change threshold value.

According to the configuration above, the increase threshold value is changed according to the timing when the time rate of change of the current value flowing through the feed motor reaches the time rate of change threshold value, and thus the feed motor can be stopped at an appropriate timing.

Embodiments

As illustrated in FIG. 1, a rebar tying machine 2 is configured to tie a plurality of rebars R with a wire W. For example, the rebar tying machine 2 can tie small-diameter rebars R having a diameter of less than 15 mm (e.g., a diameter of 10 mm or 13 mm), medium-diameter rebars R having a diameter of 15 mm or more and 25 mm or less (e.g., a diameter of 16 mm or 22 mm), and large-diameter rebars R having a diameter of 25 mm or more (e.g., a diameter of 25 mm or 32 mm) with the wire W. The diameter of the wire W is, for example, in a range from 0.5 mm to 2.0 mm.

The rebar tying machine 2 comprises a body 4, a grip 6, a battery mount 10, a battery B. and a reel holder 12. The grip 6 is a member configured to be gripped by a user. The grip 6 is positioned at a lower rear portion of the body 4. The grip 6 is integral with the body 4. A trigger 8 is attached to an upper front portion of the grip 6. The grip 6 houses a trigger switch 9 (see FIG. 2) configured to detect whether the trigger 8 is pushed in or not. The battery mount 10 is positioned at a lower portion of the grip 6. The battery mount 10 is integral with the grip 6. The battery B is detachably attached to the battery mount 10. The battery B is, for example, a lithium-ion battery. The reel holder 12 is disposed below the body 4. The reel holder 12 is disposed forward of the grip 6. In the present embodiment, a longitudinal direction of a twisting mechanism 30, which will be described later, is termed a front-rear direction, a direction orthogonal to the front-rear direction is termed an up-down direction, and a direction orthogonal to the front-rear direction and the up-down direction is termed a right-left direction.

The reel holder 12 comprises a holder housing 14 and a cover member 16. The holder housing 14 is attached to a lower front portion of the body 4 and a front portion of the battery mount 10. The cover member 16 is attached to the holder housing 14 such that it is pivotable about a pivot shaft 14*a* at a lower portion of the holder housing 14. The holder housing 14 and the cover member 16 define a housing space 12*a* (see FIG. 2). A reel 18 on which the wire W is wound is disposed in the housing space 12*a*. That is, the reel holder 12 houses the reel 18 therein.

A display unit 12*b* and a manipulatable unit 12*c* are disposed on a rear surface of the reel holder 12. The manipulatable unit 12*c* receives, from the user, manipulations regarding various settings such as tying force of the rebar tying machine 2. The display unit 12*b* is configured to display information about the present setting of the rebar tying machine 2.

Figure 2:
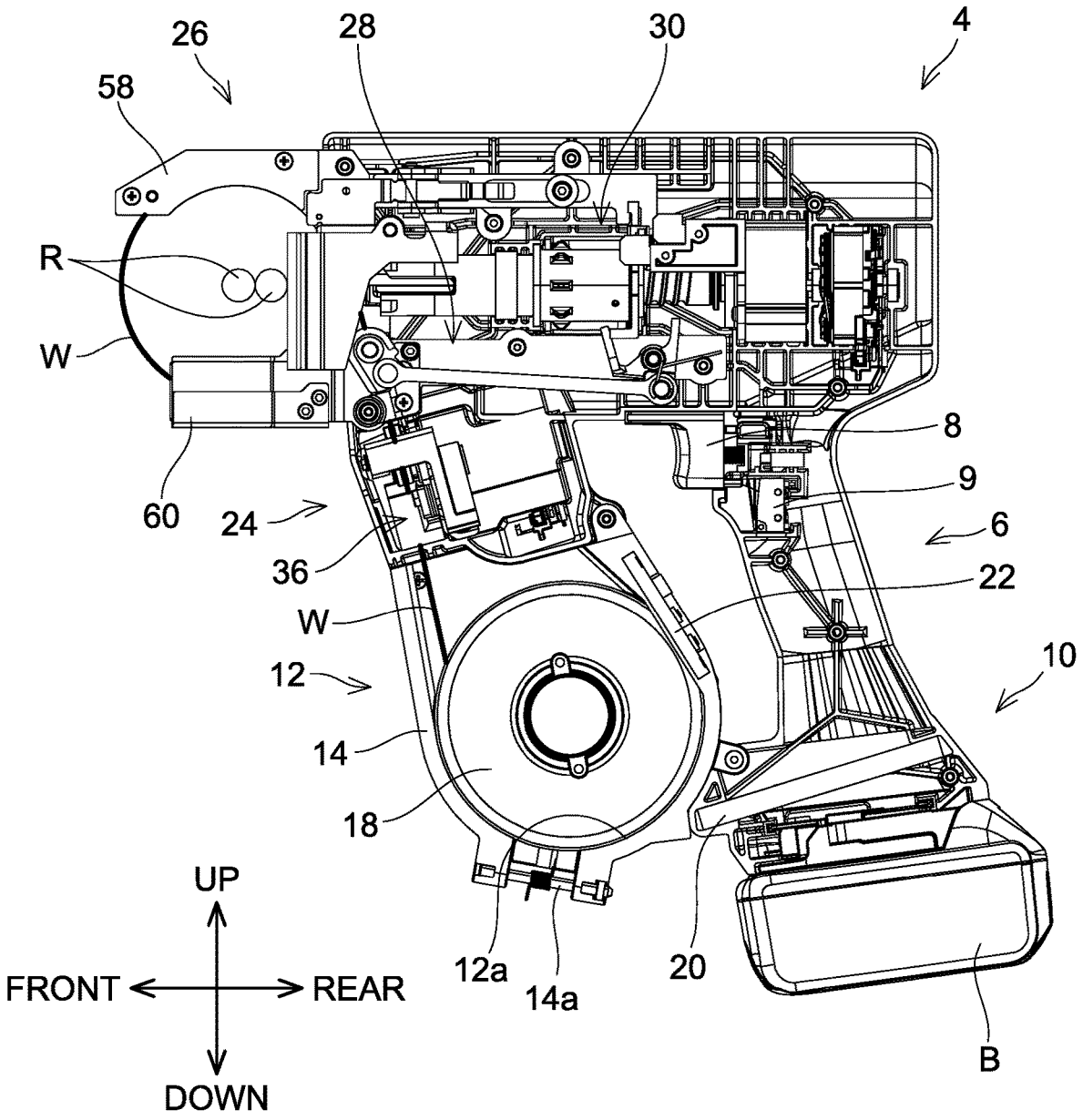
FIG. 2 is a side view of the rebar tying machine 2 according to the embodiment, illustrating an internal configuration thereof.

As illustrated in FIG. 2, the rebar tying machine 2 comprises a control board 20 and a display board 22. The control board 20 is housed in the battery mount 10. The control board 20 controls the operation of the rebar tying machine 2. The display board 22 is housed in the reel holder 12. The display board 22 is connected to the control board 20 via wiring, which is not illustrated. The display board 22 comprises a setting display LED 22*a* (see FIG. 20) configured to emit light toward the display unit 12*b* and a setting switch 22*b* (see FIG. 20) configured to detect manipulations of the user on the manipulatable unit 12*c*.

The rebar tying machine 2 comprises a feed mechanism 24, a guide mechanism 26, a cutting mechanism 28, and the twisting mechanism 30. The feed mechanism 24 is housed in the lower front portion of the body 4. The feed mechanism 24 performs a feeding-out operation by which the wire W is fed out to the guide mechanism 26 and a pulling-back operation by which the wire W is pulled back from the guide mechanism 26. The guide mechanism 26 is disposed at a front portion of the body 4. The guide mechanism 26 guides the wire W, which has been fed out from the feed mechanism 24, around the rebars R in a loop shape. The cutting mechanism 28 is housed in a lower portion of the body 4. The cutting mechanism 28 performs a cutting operation by which the wire W wound around the rebars R is cut. The twisting mechanism 30 is housed in the body 4. The twisting mechanism 30 performs a twisting operation by which the wire W around the rebars R is twisted.

(Configuration of Feed Mechanism 24)

Figure 3:
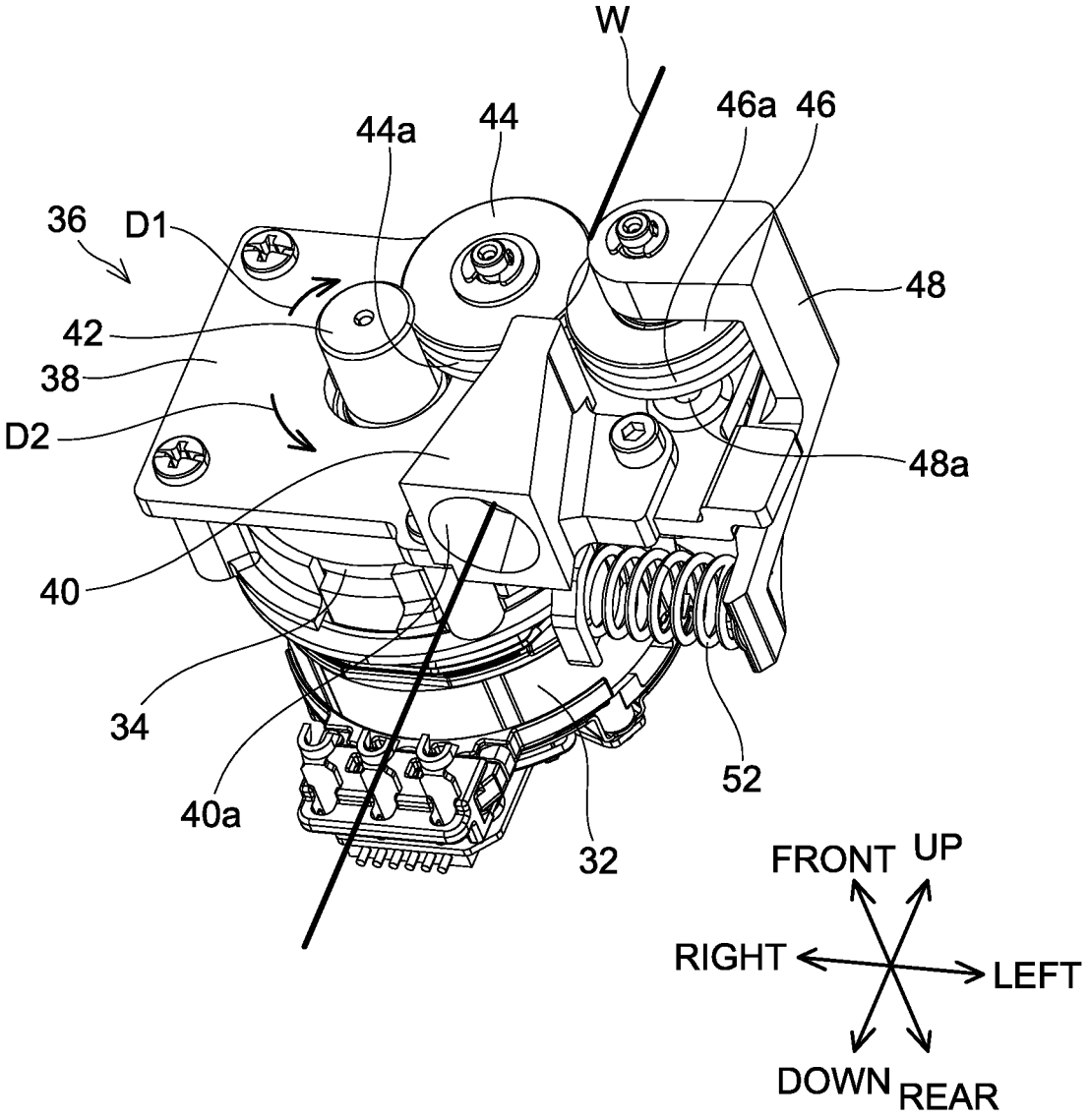
FIG. 3 is a perspective view of a feed mechanism 24 of the rebar tying machine 2 according to the embodiment.

As illustrated in FIG. 3, the feed mechanism 24 comprises a feed motor 32, a reducer 34, and a feeder 36. The feed motor 32 is connected to the control board 20 via wiring, which is not illustrated. The feed motor 32 is driven by electric power supplied from the battery 13. The feed motor 32 is controlled by the control board 20. The feed motor 32 is connected to a drive gear 42 of the feeder 36 via the reducer 34. The reducer 34 reduces the rotation of the feed motor 32, for example, by a planetary gear mechanism and transmits it to the drive gear 42.

Figure 18:
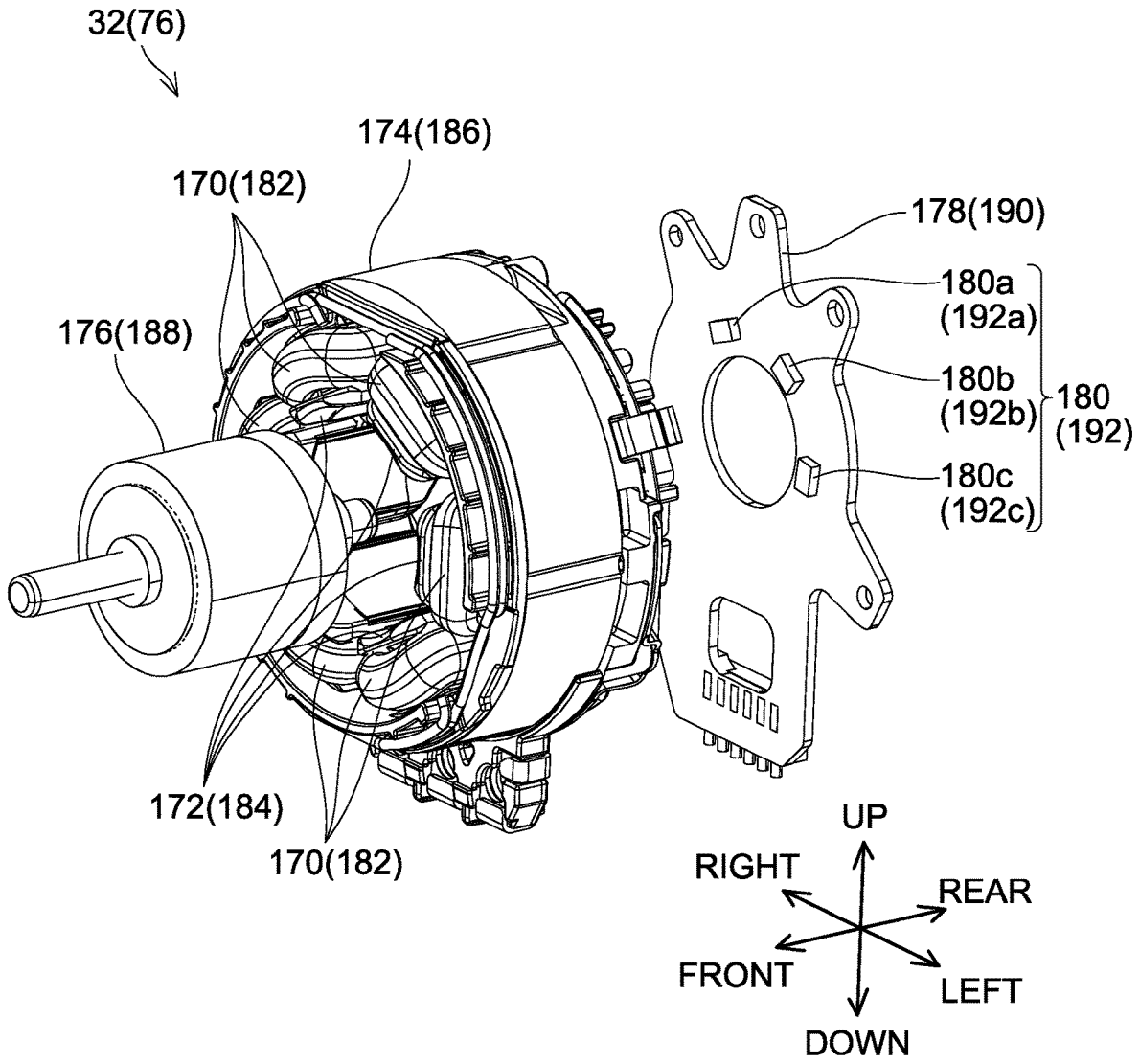
FIG. 18 is a perspective exploded view of a feed motor 32 and a twisting motor 76 of the rebar tying machine 2 according to the embodiment.
Figure 19:
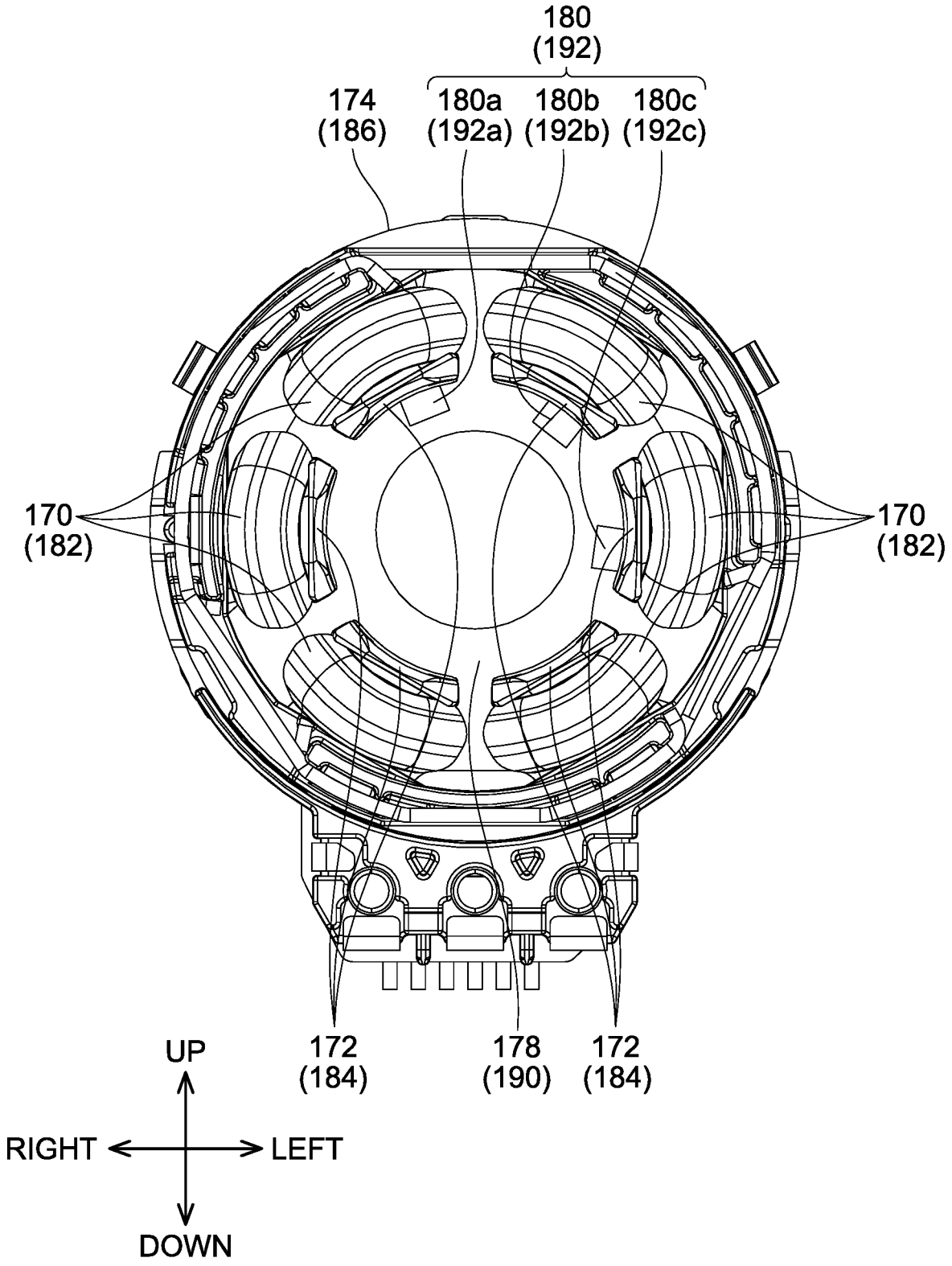
FIG. 19 is a front view of stators 174, 186 and sensor boards 178, 190 of the feed motor 32 and the twisting motor 76 of the rebar tying machine 2 according to the embodiment.

In the present embodiment, the feed motor 32 is a brushless motor. As illustrated in FIG. 18, the feed motor 32 comprises a stator 174 including teeth 172 on which coils 170 are wound, a rotor 176 disposed inside the stator 174, and a sensor board 178 fixed to the stator 174. The stator 174 is constituted of a magnetic body. The rotor 176 comprises a permanent magnet in which magnetic poles are circumferentially arranged. As illustrated in FIG. 19, the sensor board 178 comprises a Hall sensor 180. The Hall sensor 180 includes a first Hall element 180*a*, a second Hall element 180*b*, and a third Hall element 180*c*. The first Hall element 180*a*, the second Hall element 180*b*, and the third Hall element 180*c* detect magnetic forces from the rotor 176. The Hall sensor 180 is positioned on the sensor board 178 such that an electrical angle is advanced by 25 degrees for the forward rotation of the feed motor 32 and the electrical angle is delayed by 25 degrees for the reverse rotation of the feed motor 32. In the present embodiment, for the reverse rotation of the feed motor 32, the control board 20 outputs a pattern offset by an electrical angle of 60 degrees. Thus, for the forward rotation of the feed motor 32, control is performed such that the electrical angle is advanced by 25 degrees, while for the reverse rotation of the feed motor 32, control is performed such that the electrical angle is advanced by 35 degrees (=60 degrees−25 degrees).

As illustrated in FIG. 3, the feeder 36 comprises a base member 38, a guide member 40, the drive gear 42, a first gear 44, a second gear 46, a gear supporting member 48, and a biasing member 52. The guide member 40 is fixed to the base member 38. The guide member 40 includes a guide hole 40*a*. The guide hole 40*a* has a tapered shape that is broad at its lower end and narrower at its upper end. The wire W is inserted through the guide hole 40*a*.

The drive gear 42 is coupled to the reducer 34. The first gear 44 is rotatably supported by the base member 38. The first gear 44 meshes with the drive gear 42. The first gear 44 is rotated by the rotation of the drive gear 42. The first gear 44 includes a groove 44*a*. The groove 44*a* is formed in an outer circumferential surface of the first gear 44 and extends along a rotation direction of the first gear 44. The second gear 46 meshes with the first gear 44. The second gear 46 is rotatably supported by the gear supporting member 48. The second gear 46 includes a groove 46*a*. The groove 46*a* is formed in an outer circumferential surface of the second gear 46 and extends in a rotation direction of the second gear 46. The gear supporting member 48 is swingably supported by the base member 38 via a swing shaft 48*a*. The biasing member 52 biases the gear supporting member 48 such that the second gear 46 is brought closer to the first gear 44. Thus, the second gear 46 is pressed against the first gear 44. As a result, the wire W is held between the groove 44*a* of the first gear 44 and the groove 46*a* of the second gear 46. When the gear supporting member 48 is pushed against the biasing force of the biasing member 52, the second gear 46 separates from the first gear 44. This facilitates the insertion of the wire W between the groove 44*a* of the first gear 44 and the groove 46*a* of the second gear 46 when the reel 18 is replaced.

The wire W is moved by the feed motor 32 rotating with the wire W held between the groove 44*a* of the first gear 44 and the groove 46*a* of the second gear 46. In the present embodiment, when the feed motor 32 rotates in reverse, the drive gear 42 rotates in a direction D1 illustrated in FIG. 3, and thus the wire W is fed out toward the guide mechanism 26. When the feed motor 32 rotates forward, the drive gear 42 rotates in a direction D2 illustrated in FIG. 3, and thus the wire W is pulled back from the guide mechanism 26.

(Configuration of Guide Mechanism 26)

Figure 4:
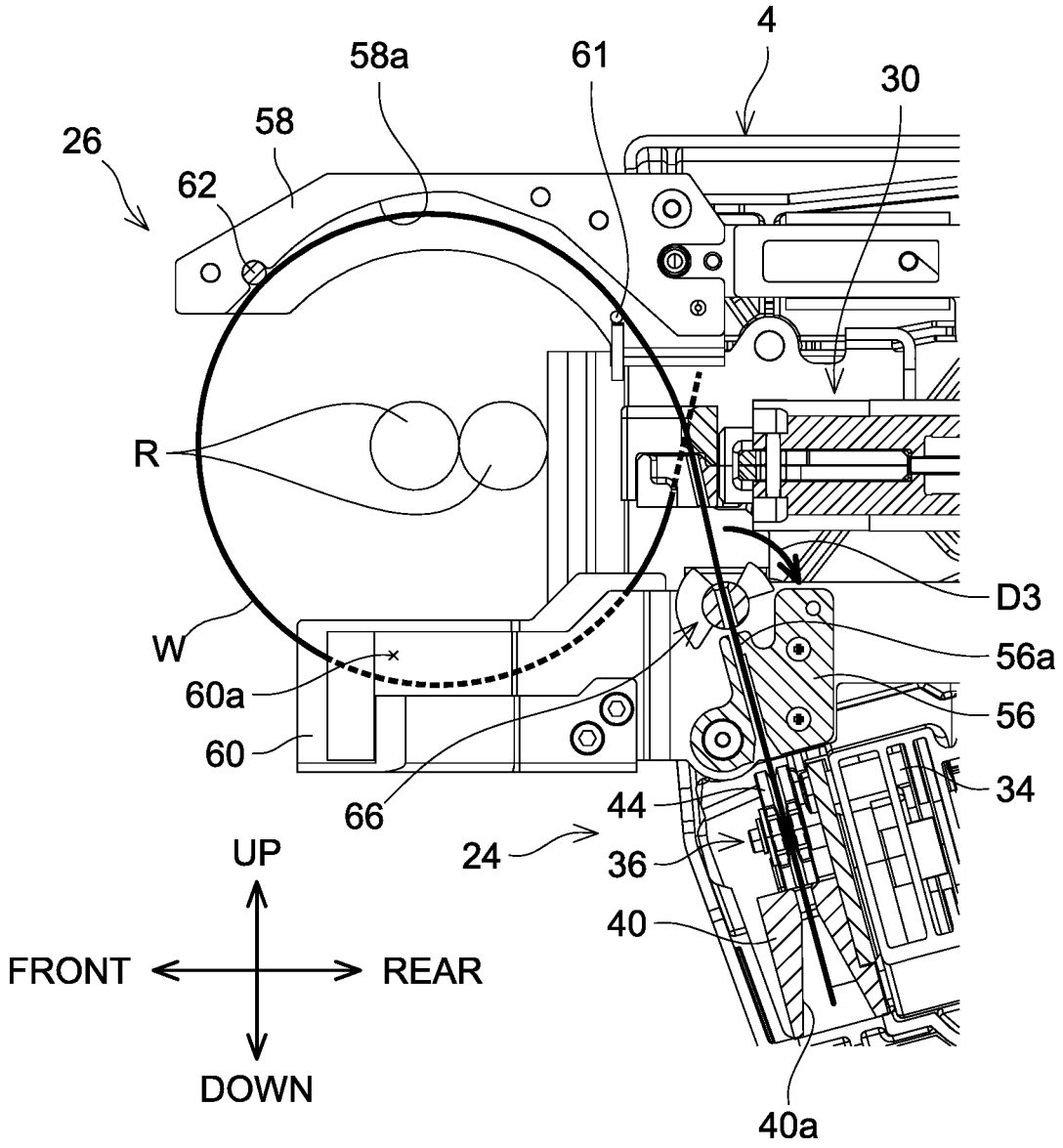
FIG. 4 is a sectional view of the rebar tying machine 2 according to the embodiment in the vicinity of a guide mechanism 26.

As illustrated in FIG. 4, the guide mechanism 26 comprises a wire guide 56, an upper guide arm 58, and a lower guide arm 60. The wire W fed out from the feed mechanism 24 passes through the inside of the wire guide 56. A protrusion 56*a* is arranged on the inside of the wire guide 56.

The upper guide arm 58 is disposed at an upper front portion of the body 4. The upper guide arm 58 includes an upper guide path 58*a*. The wire W that has passed through the inside of the wire guide 56 passes the upper guide path 58*a*. A first guide pin 61 and a second guide pin 62 are disposed at the upper guide path 58*a*. Once the wire W passes through the upper guide path 58*a* while contacting the protrusion 56*a* of the wire guide 56, the first guide pin 61, and the second guide pin 62, the wire W is downwardly curled.

The lower guide arm 60 is disposed at a lower front portion of the body 4. The lower guide arm 60 includes a lower guide path 60*a*. The wire W that has passed through the upper guide path 58*a* passes the lower guide path 60*a*. In FIG. 4, portions of the wire W that are hidden by the lower guide arm 60 and the twisting mechanism 30 are indicated by broken lines.

(Configuration of Cutting Mechanism 28)

Figure 5:
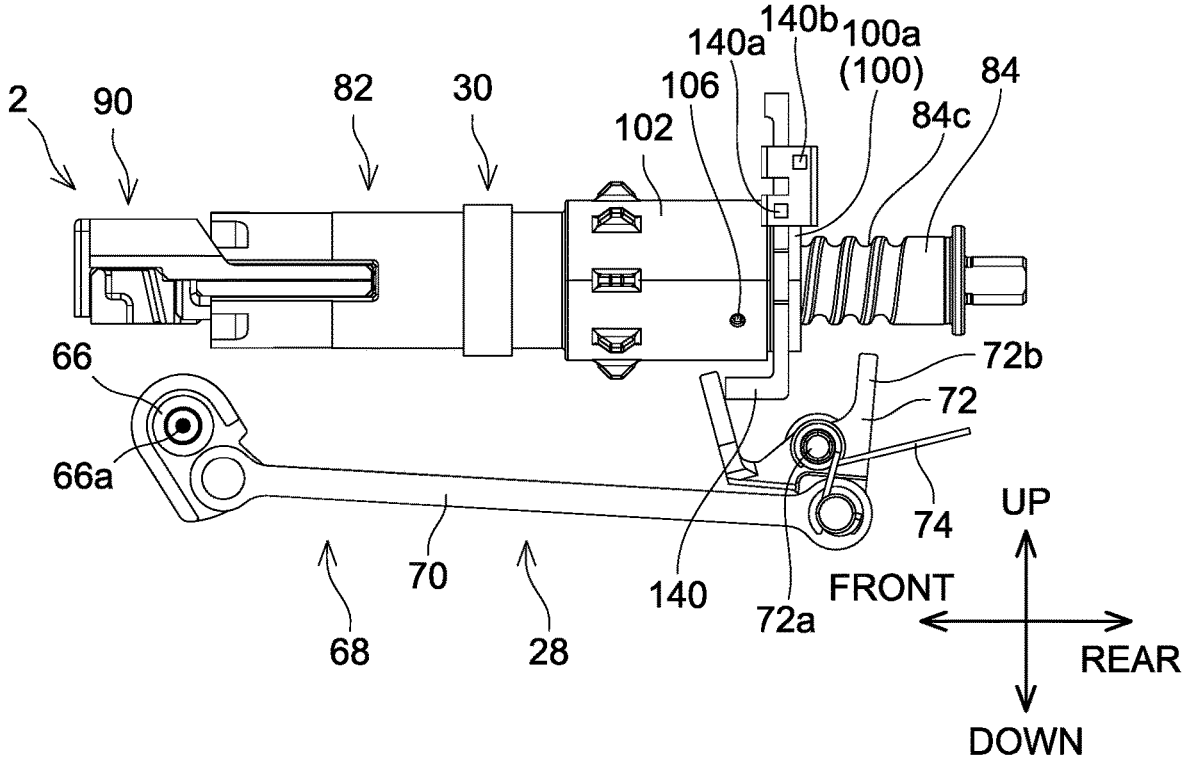
FIG. 5 is aside view of a holder 82 and a cutting mechanism 28 of the rebar tying machine 2 according to the embodiment when an operable member 72 is at an initial position.

As illustrated in FIG. 5, the cutting mechanism 28 comprises a cutting member 66 and a link 68. The cutting member 66 is a member configured to cut the wire W. As illustrated in FIG. 4, the cutting member 66 is disposed on a route that the wire W follows from the feed mechanism 24 to the guide mechanism 26. The wire W passes through the inside of the cutting member 66. The cutting member 66 is supported such that it is rotatable about a rotation shaft 66*a* (see FIG. 5) with respect to the body 4. When the cutting member 66 is rotated in a direction D3 illustrated in FIG. 4, the wire W is cut by the cutting member 66.

As illustrated in FIG. 5, the link 68 comprises a link member 70, an operable member 72, and a biasing member 74. The link member 70 links the cutting member 66 and the operable member 72. The operable member 72 is supported such that it is rotatable about a rotation shaft 72*a* with respect to the body 4. The operable member 72 is normally biased by the biasing member 74 to be at an initial position. When a force that is larger than the biasing force of the biasing member 74 is applied to the operable member 72, the operable member 72 is thereby rotated about the rotation shaft 72*a*. As a result, the link member 70 is moved forward and the cutting member 66 is rotated about the rotation shaft 66*a*. When the operable member 72 is rotated about the rotation shaft 72*a* from the initial position to a predetermined position illustrated in FIG. 6, the wire W is cut by the rotation of the cutting member 66. Hereinafter, the predetermined position of the operable member 72 is termed a cutting position.

(Configuration of Twisting Mechanism 30)

Figure 7:
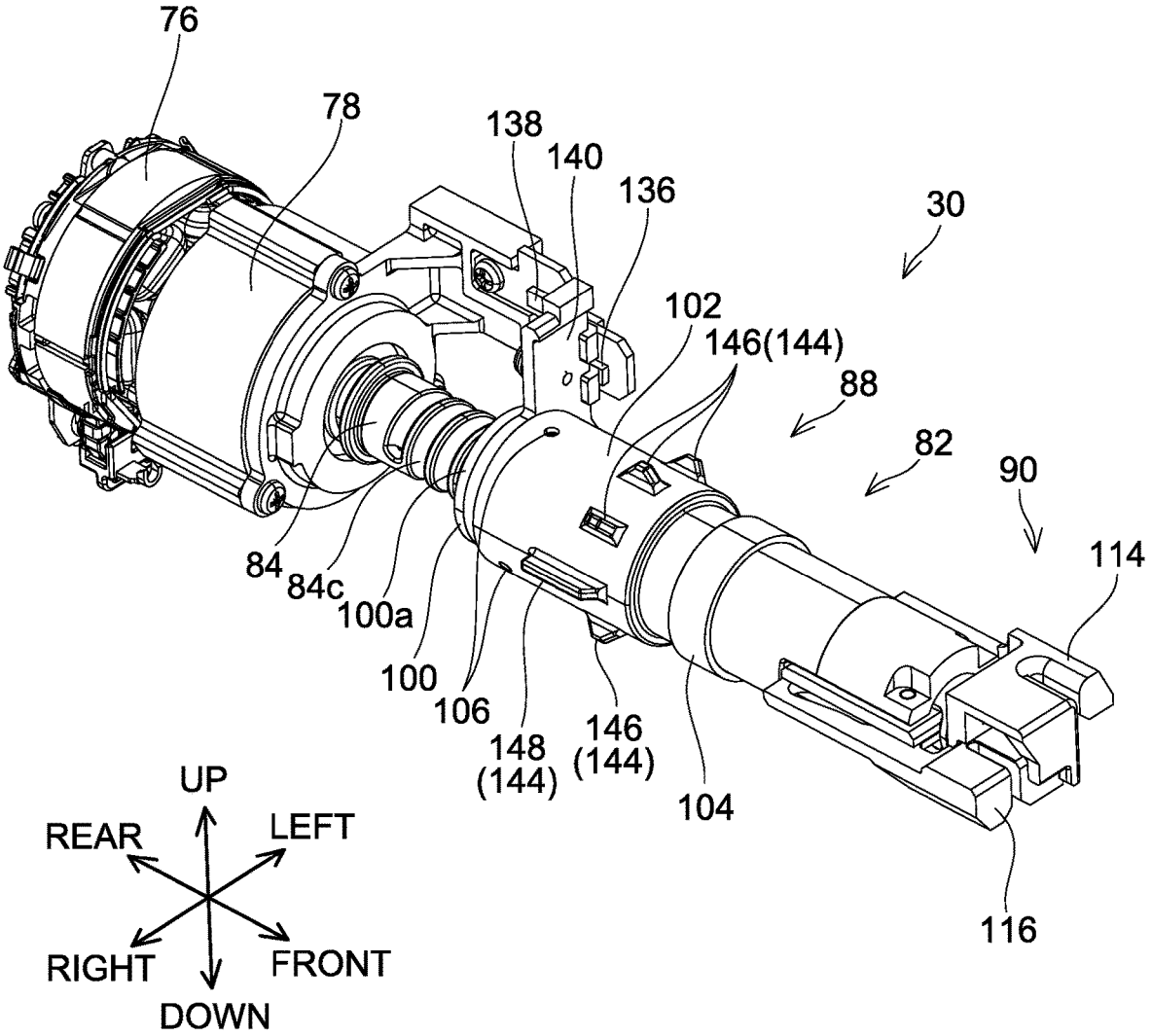
FIG. 7 is a perspective view of a twisting mechanism 30 of the rebar tying machine 2 according to the embodiment.

As illustrated in FIG. 7, the twisting mechanism 30 comprises a twisting motor 76, a reducer 78, and a holder 82. The twisting motor 76 is connected to the control board 20 via wiring, which is not illustrated. The twisting motor 76 is driven by electric power supplied from the battery B. The twisting motor 76 is controlled by the control board 20. The twisting motor 76 is connected to a screw shaft 84 of the holder 82 via the reducer 78. The reducer 78 reduces the rotation of the twisting motor 76, for example, by a planetary gear mechanism, and transmits it to the screw shaft 84.

In the present embodiment, the twisting motor 76 is a brushless motor. In the present embodiment, the twisting motor 76 comprises the same configuration as the configuration of the feed motor 32. As illustrated in FIG. 18, the twisting motor 76 comprises a stator 186 including teeth 184 on which coils 182 are wound, a rotor 188 disposed inside the stator 186, and a sensor board 190 fixed to the stator 186. The stator 186 is constituted of a magnetic body. The rotor 188 comprises a permanent magnet in which magnetic poles are circumferentially arranged. As illustrated in FIG. 19, the sensor board 190 comprises a Hall sensor 192. The Hall sensor 192 includes a first Hall element 192*a*, a second Hall element 192*b*, and a third Hall element 192*c*. The first Hall element 192*a*, the second Hall element 192*b*, and the third Hall element 192*c* detect magnetic forces from the rotor 188. The Hall sensor 192 is disposed on the sensor board 190 such that an electrical angle is advanced by 25 degrees for the forward rotation of the twisting motor 76 and the electrical angle is delayed by 25 degrees for the reverse rotation of the twisting motor 76. In the present embodiment, for the reverse rotation of the twisting motor 76, the control board 20 outputs a pattern offset by an electrical angle of 60 degrees. Thus, for the forward rotation of the twisting motor 76, control is performed such that the electrical angle is advanced, by 25 degrees, while for the reverse rotation of the twisting motor 76, control is performed such that the electrical angle is advanced by 35 degrees (=60 degrees−25 degrees).

In the present embodiment, the twisting motor 76 and the feed motor 32 comprises the same configuration. Thus, the common components are used for the stator 174 and the stator 186, the common components are used for the rotor 176 and the rotor 188, and the common components are used for the sensor board 178 and the sensor board 190.

As illustrated in FIG. 7, the holder 82 comprises the screw shaft 84, a clamp guide 86 (see FIGS. 8, 9), a biasing member 92 (see FIGS. 8, 9), a sleeve 88, and a holder member 90.

The screw shaft 84 is connected to the reducer 78. When the twisting motor 76 rotates forward, the screw shaft 84 rotates counterclockwise as viewed from the back of the screw shaft 84. When the twisting motor 76 rotates in reverse, the screw shaft 84 rotates clockwise as viewed from the back of the screw shaft 84.

Figure 8:
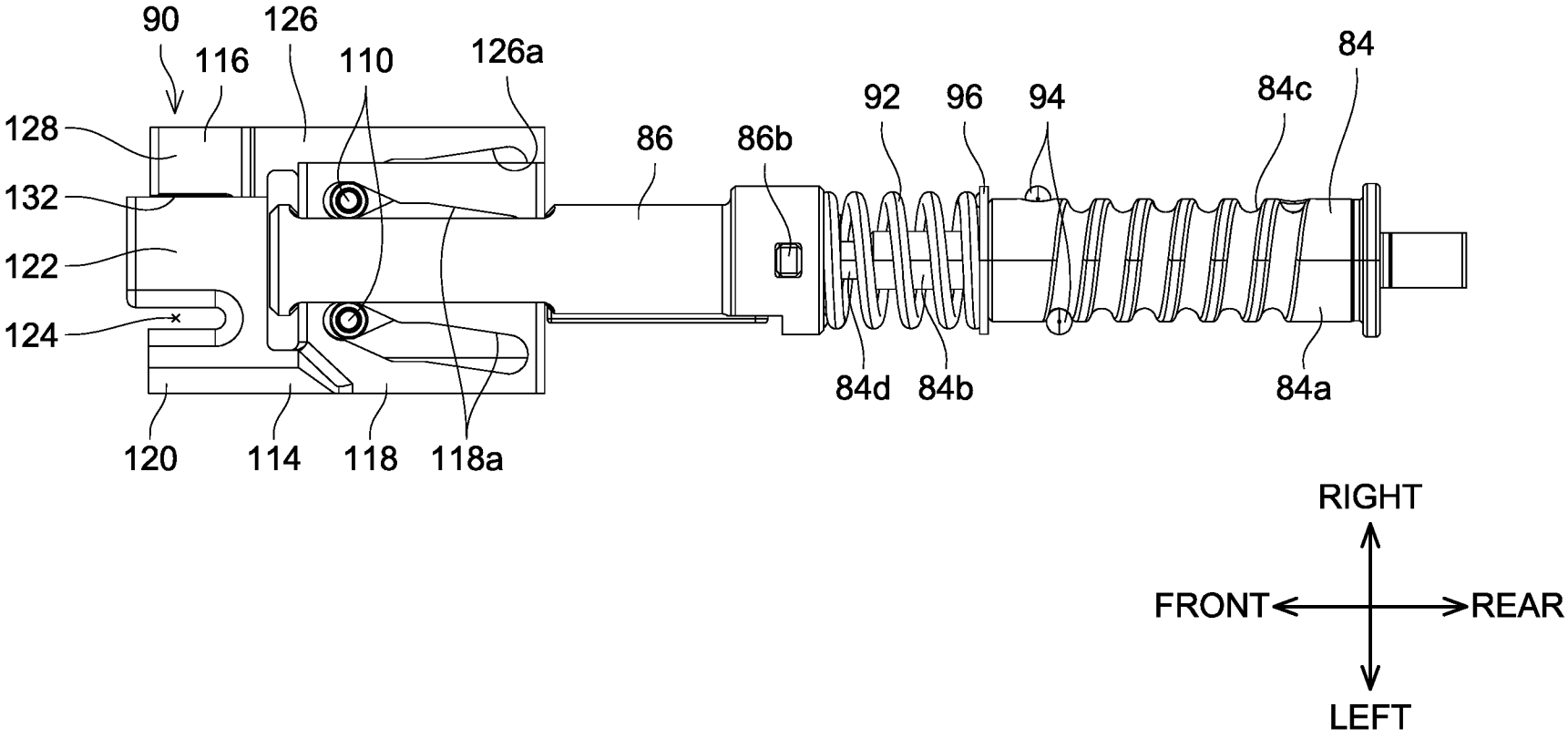
FIG. 8 is a top view of a screw shaft 84, a clamp guide 86, a holder member 90, and a biasing member 92 of the rebar tying machine 2 according to the embodiment.

As illustrated in FIG. 8, the screw shaft 84 comprises a large diameter portion 84*a* and a small diameter portion 84*b*. The large diameter portion 84*a* is positioned at a rear portion of the screw shaft 84, and the small diameter portion 84*b* is positioned at a front portion of the screw shaft 84. A helical ball groove 84*c* is formed in an outer circumference surface of the large diameter portion 84*a*. Balls 94 fit in the ball groove 84*c*. An annular washer 96 is disposed at a step between the large diameter portion 84*a* and the small diameter portion 84*b*. An engagement groove 84*d* is formed in a front portion of the small diameter portion 84*b*.

Figure 9:
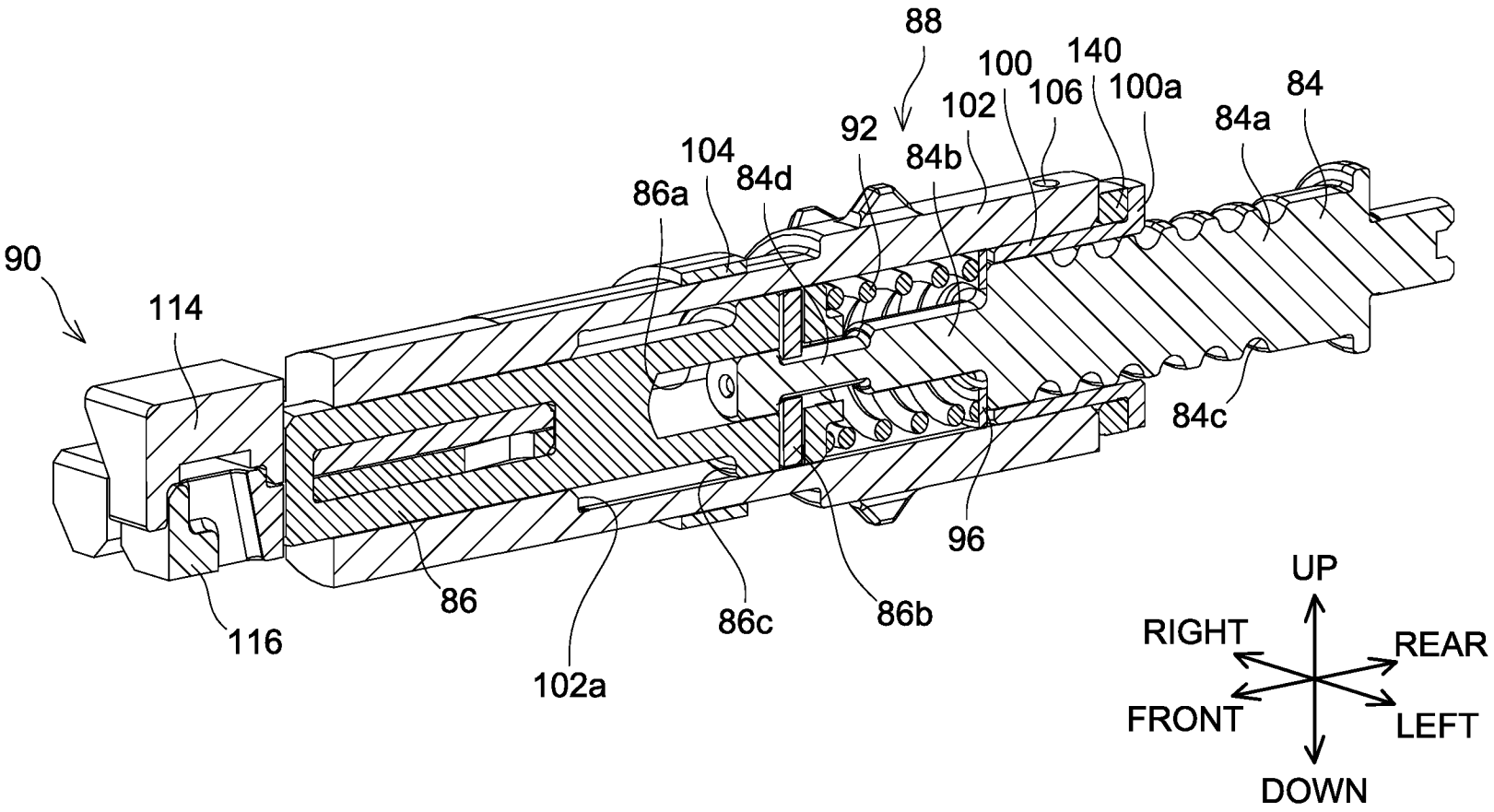
FIG. 9 is a perspective sectional view of the holder 82 when an outer sleeve 102 of the rebar tying machine 2 according to the embodiment is at an advance position with respect to the clamp guide 86.

As illustrated in FIG. 9, the front portion of the small diameter portion 84*b* is inserted in a recess 86*a* of the clamp guide 86. An engagement pin 86*b* of the clamp guide 86 is inserted in the engagement groove 84*d* of the small diameter portion 84*b* of the screw shaft 84 and is engageable with a front surface and a rear surface of the engagement groove 84*d*. A step 86*c* is arranged on an outer circumferential surface of the clamp guide 86. A portion of the outer circumferential surface of the clamp guide 86 that is rearward of the step 86*c* has a larger diameter than a portion of the outer circumferential surface of the clamp guide 86 that is forward of the step 86*c*.

The small diameter portion 84*b* is inserted through the biasing member 92. The biasing member 92 is disposed between the washer 96 and the clamp guide 86. The biasing member 92 biases the clamp guide 86 in a direction that brings it away from the washer 96.

The screw shaft 84 and the clamp guide 86 are inserted in the sleeve 88. The sleeve 88 comprises an inner sleeve 100 and an outer sleeve 102. The large diameter portion 84*a* of the screw shaft 84 is inserted through the inner sleeve 100. Ball holes (not illustrated) are formed in the inner sleeve 100. The balls 94 fit in the ball holes. The inner sleeve 100 is connected to the screw shaft 84 via the balls 94 fitted between the ball groove 84*c* and the ball holes, i.e., via a ball screw. When the screw shaft 84 rotates with respect to the inner sleeve 100, the inner sleeve 100 moves in the front-rear direction with respect to the screw shaft 84 in the range where the ball groove 84*c* is formed.

The screw shalt 84, the clamp guide 86, and the inner sleeve 100 are inserted in the outer sleeve 102. The outer sleeve 102 has a cylindrical shape extending in the front-rear direction. A step 102*a* is formed on an inner surface of the outer sleeve 102. A portion of the inner surface of the outer sleeve 102 that is positioned forward of the step 102*a* has a smaller diameter than a portion of the inner surface of the outer sleeve 102 that is positioned rearward of the step 102*a*. The outer sleeve 102 is fixed to the inner sleeve 100 with a set screw 106. The outer sleeve 102 moves (i.e., translates or rotates) along with the inner sleeve 100. In the range where the ball groove 84*c* is formed, the outer sleeve 102 moves, along with the inner sleeve 100, in the front-rear direction with respect to the screw shaft 84 when the screw shaft 84 rotates with respect to the inner sleeve 100. Further, the outer sleeve 102 moves with respect to the clamp guide 86 between an advance position and a receding position when the screw shaft 84 rotates with respect to the inner sleeve 100. Hereinafter, "the outer sleeve 102 advances" means that the outer sleeve 102 moves toward the advance position (i.e., forward) with respect to the clamp guide 86, and "the outer sleeve 102 recedes" means that the outer sleeve 102 moves toward the receding position (i.e., rearward) with respect to the clamp guide 86.

The holder 82 further comprises a support member 104. The support member 104 covers an outer surface of the outer sleeve 102. The support member 104 is rotatable with respect to the outer sleeve 102. The support member 104 is movable in the front-rear direction with respect to the outer sleeve 102. The outer sleeve 102 is supported by the body 4 via the support member 104.

The holder member 90 is supported at a front portion of the clamp guide 86. The holder member 90 is supported by two guide pins 110 (see FIG. 8) of the outer sleeve 102 such that it is movable with respect to the outer sleeve 102. The holder member 90 is configured to hold the wire W. The holder member 90 opens and closes in conjunction with the rotation of the screw shaft 84.

Figure 10:
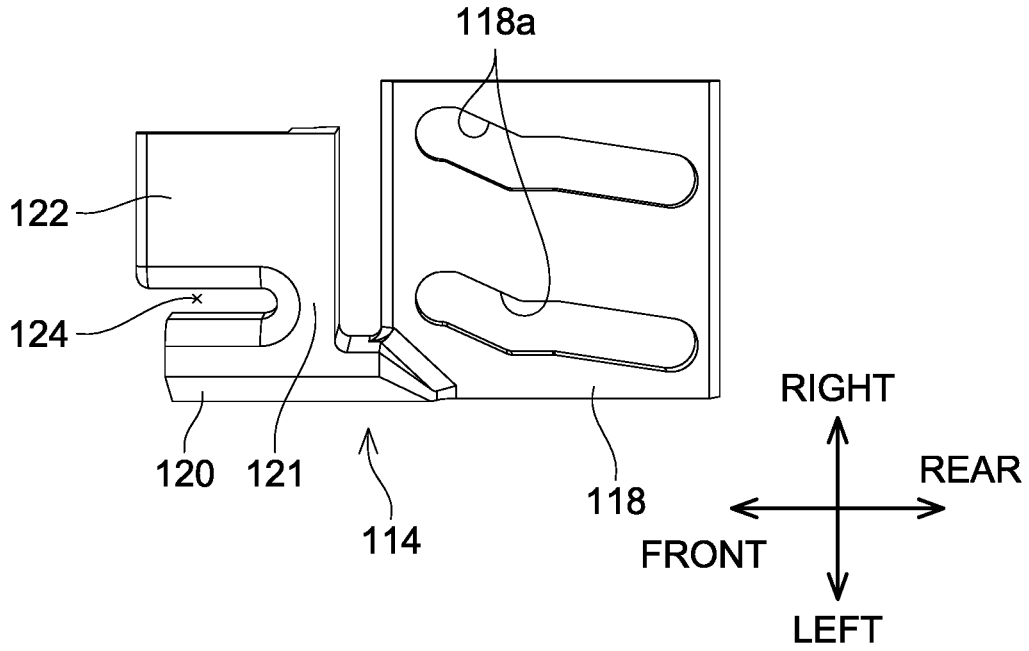
FIG. 10 is a top view of an upper holder member 114 of the rebar tying machine 2 according to the embodiment.

The holder member 90 comprises an upper holder member 114 and a lower holder member 116. The upper holder member 114 faces the lower holder member 116 in the up-down direction. As illustrated in FIG. 10, the upper holder member 114 comprises an upper base 118, a first upper projection 120, an upper connection 121, and a second upper projection 122. The upper base 118 is a portion supported by the clamp guide 86 and the guide pins 110. The upper base 118 comprises two upper guide holes 118*a*. The two upper guide holes 118*a* has the same shape. The two upper guide holes 118*a* extend in the front-rear direction, and are inclined rightward from the rear toward the front when the upper base 118 is viewed from above.

The first upper projection 120 extends forward from a left front end of the upper base 118. The upper connection 121 extends rightward from a right end of a center portion of the first upper projection 120. The second upper projection 122 extends forward from the upper connection 121. The first upper projection 120 is separated from the second upper projection 122 in the right-left direction. A first wire path 124 is defined between the first upper projection 120 and the second upper projection 122. The wire W passes the first wire path 124 after fed out from the feed mechanism 24 and before reaching the upper guide path 58*a* of the guide mechanism 26.

Figure 12:
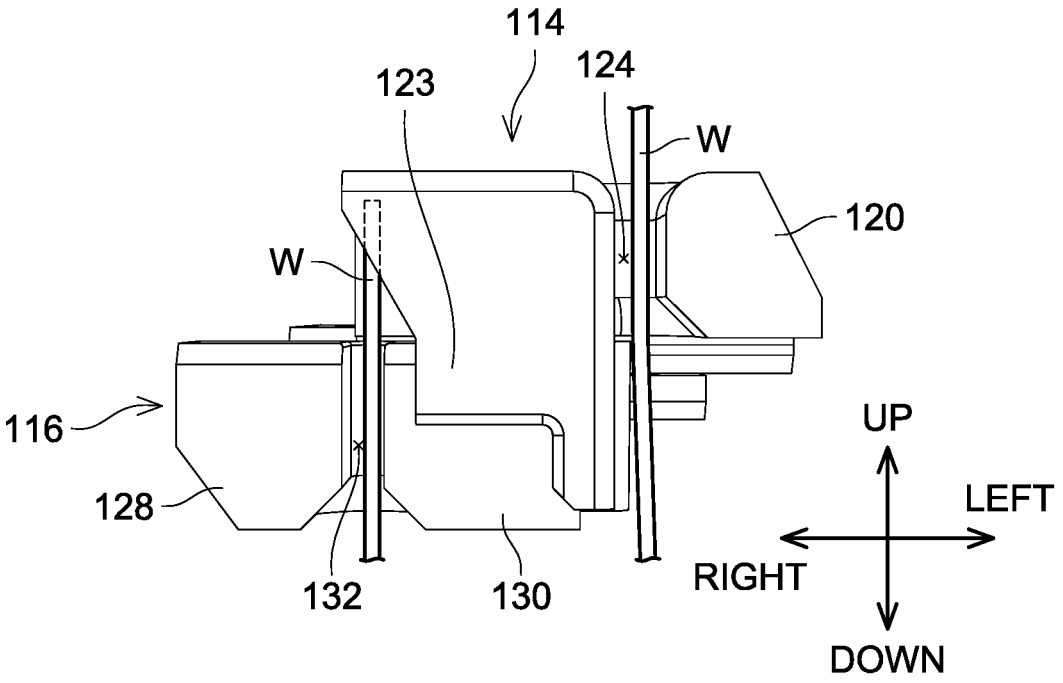
FIG. 12 is a front view of the holder member 90 of the rebar tying machine 2 according to the embodiment.

The holder member 90 further comprises a first retainer 123 as illustrated in FIG. 12. The first retainer 123 is integral with the upper holder member 114. The first retainer 123 extends downward from a front end of the second upper projection 122. The first retainer 123 partially overlaps the lower holder member 116 in the front-rear direction. The first retainer 123 prevents the wire W held by the holder member 90 from slipping out of the holder member 90.

Figure 11:
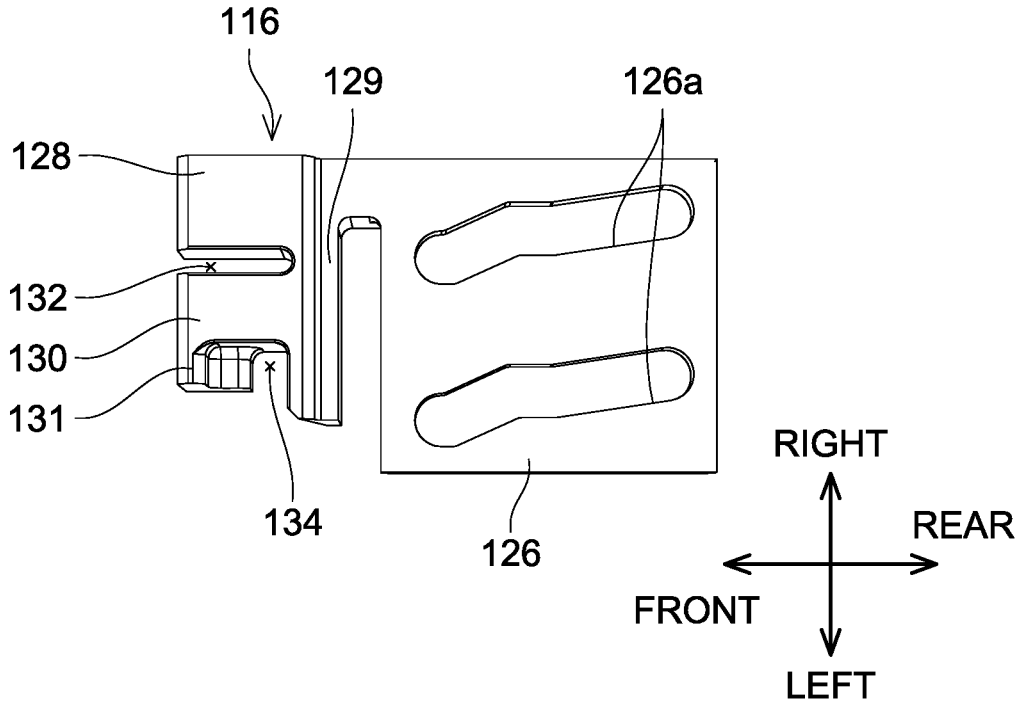
FIG. 11 is a top view of a lower holder member 116 of the rebar tying machine 2 according to the embodiment.

As illustrated in FIG. 11, the lower holder member 116 comprises a lower base 126, a first lower projection 128, a lower connection 129, and a second lower projection 130. The lower base 126 is a portion supported by the clamp guide 86 and the guide pins 110. The lower base 126 comprises two lower guide holes 126*a*. With respect to a plane orthogonal to the right-left direction, the shape of the lower guide holes 126*a* as the lower base 126 is viewed from above is symmetrical to the upper guide holes 118*a* as the upper base 118 is viewed from above. That is, the two lower guide holes 126*a* extend in the front-rear direction, and are inclined leftward from the rear toward the front as the lower base 126 is viewed from above.

The first lower projection 128 extends forward from a right front end of the lower base 126. The lower connection 129 extends leftward from a left end of a center portion of the first lower projection 128. The second lower projection 130 extends forward from a front end of a center portion of the lower connection 129. The first lower projection 128 is separated from the second lower projection 130 in the right-left direction. A second wire path 132 is defined between the first lower projection 128 and the second lower projection 130. The wire W passes the second wire path 132 after having passed through the lower guide path 60*a* of the guide mechanism 26.

The holder member 90 further comprises a second retainer 131. The second retainer 131 is integral with the lower holder member 116. The second retainer 131 extends leftward from a left front end of the second lower projection 130. The second retainer 131 prevents the wire W held by the holder member 90 from slipping out of the holder member 90. The second retainer 131 is separated from the lower connection 129 in the front-rear direction. An auxiliary path 134 is defined between the second retainer 131 and the lower connection 129.

As illustrated in FIG. 8, the guide pins 110 of the outer sleeve 102 are inserted in the upper guide holes 118*a* and the lower guide holes 126*a* when the upper holder member 114 and the lower holder member 116 overlaps each other in the up-down direction. When the outer sleeve 102 moves in the front-rear direction with respect to the clamp guide 86, the guide pins 110 move in the front-rear direction within the upper guide holes 118*a* and the lower guide holes 126*a*. When the guide pins 110 are in front portions of the upper guide holes 118*a* and the lower guide holes 126*a*, the first wire path 124 and the second wire path 132 are open as illustrated in FIG. 12. This state of the holder member 90 is termed a fully open state.

Figure 13:
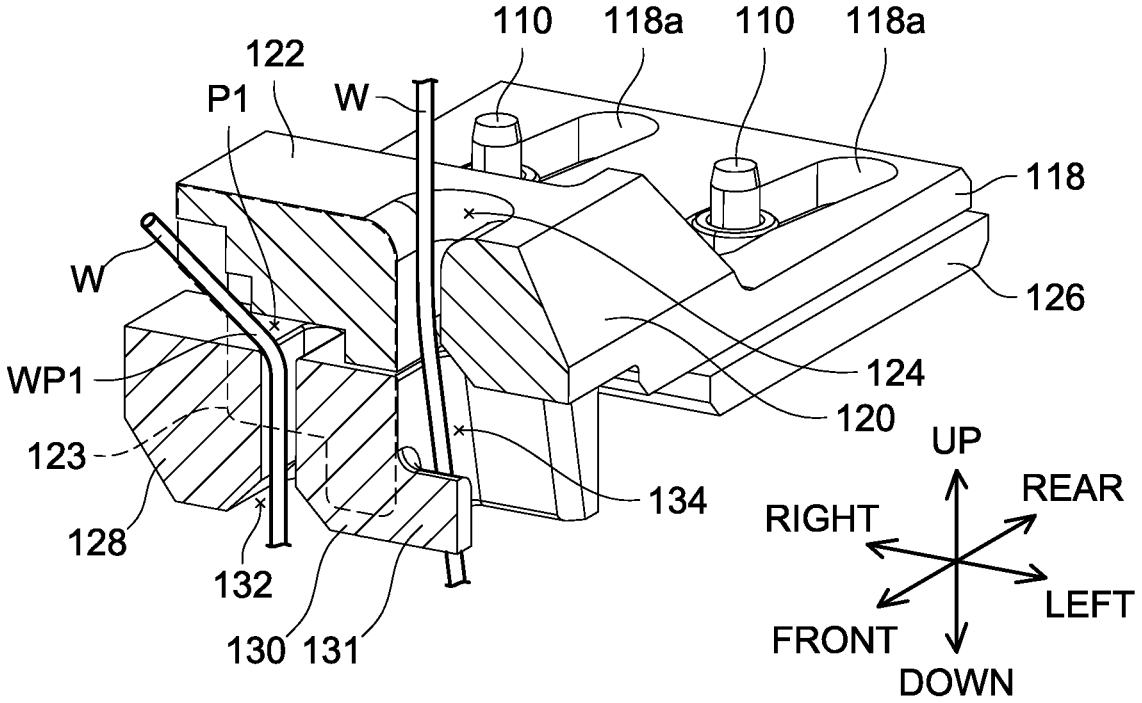
FIG. 13 is a perspective sectional view of the holder member 90 and guide pins 110 of the rebar tying machine 2 according to the embodiment when the guide pins 110 are positioned at intermediate positions in upper guide holes 118*a* and lower guide holes 126*a*.

When the outer sleeve 102 recedes with respect to the clamp guide 86, the guide pins 110 move rearward within the upper guide holes 118*a* and the lower guide holes 126*a*. When the upper holder member 114 moves rightward with respect to the clamp guide 86, the lower holder member 116 moves leftward (i.e., in the opposite direction to the direction in which the upper holder member 114 moves) with respect to the clamp guide 86. The distance the upper holder member 114 moves rightward is equal to the distance the lower holder member 116 moves leftward. As the holder member 90 is viewed in the up-down direction, the upper holder member 114 and the lower holder member 116 move toward each other. When the guide pins 110 move to intermediate positions within the upper guide holes 1/8*a* and the lower guide holes 126*a* as illustrated in FIG. 13, the second wire path 132 is blocked by the second upper projection 122, while the first wire path 124 is open due to the auxiliary path 134 formed in the second lower projection 130. This state of the holder member 90 is termed a half open state. If the wire W is in the second wire path 132, the wire W is held and fixed at a first holding site P1 between the second upper projection 122 and the first lower projection 128. Hereinafter, a portion of the wire W that is held at the first holding site P1 is termed a first held portion WP1. In the half open state, the first retainer 123 blocks the first holding site P1 from the front. In FIG. 13, the position of the first retainer 123 with respect to the front-rear direction is indicated by the broken line. The first retainer 123 is positioned between the rebars R (not illustrated in FIG. 13) and the first holding site P1.

Figure 14:
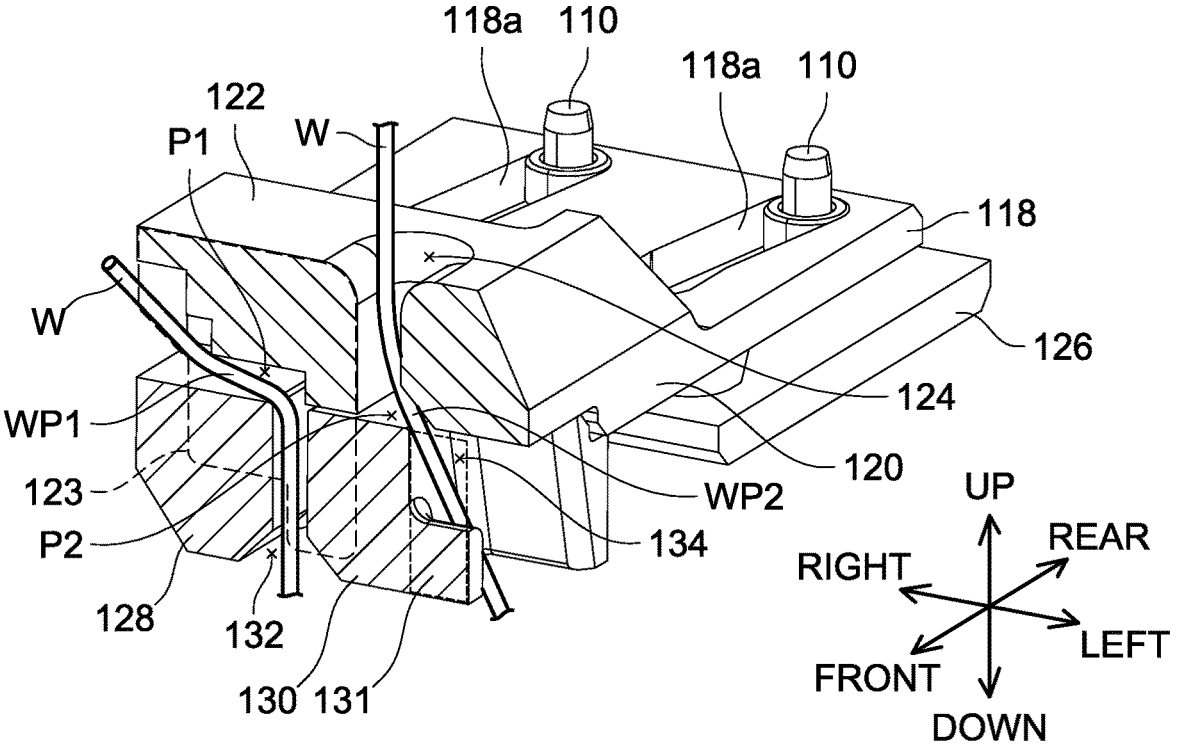
FIG. 14 is a perspective sectional view of the holder member 90 and the guide pins 110 of the rebar tying machine 2 according to the embodiment when the guide pins 110 are positioned in rear portions in the upper guide holes 18*a* and the lower guide holes 126*a*.

When the guide pins 110 move to rear portions of the upper guide holes 118*a* and the lower guide holes 126*a* as illustrated in FIG. 14, the first wire path 124 is blocked by the second lower projection 130, and the second wire path 132 remains blocked by the second upper projection 122. This state of the holder member 90 is termed a fully closed state. If the wire W is in the first wire path 124, the wire W is held and fixed at a second holding site P2 between the first upper projection 120 and the second lower projection 130, while the first held portion WP1 of the wire W remains held at the first holding site P1 of the holder member 90. Hereinafter, a portion of the wire W that is held at the second holding site P2 is termed a second held portion WP2. In the fully closed state, the first retainer 123 blocks the first holding site P1 from the front and the second retainer 131 is positioned immediately below and forward of the second holding site P2. In FIG. 14, a front end of the second retainer 131 is depicted by a shorter-dashed line than the dashed line depicting the first retainer 123. The second retainer 131 is positioned between the rebars R (not illustrated in FIG. 14) and the second holding site P2.

As illustrated in FIG. 7, the holder 82 further comprises a push plate 140. The push plate 140 is held between a rib 100*a* arranged on a rear end portion of the inner sleeve 100 and a rear end portion of the outer sleeve 102. In response to the rotation of the screw shaft 84 by the twisting motor 76, the push plate 140 moves in the front-rear direction with respect to the screw shaft 84, along with the inner sleeve 100 and the outer sleeve 102.

Figure 6:
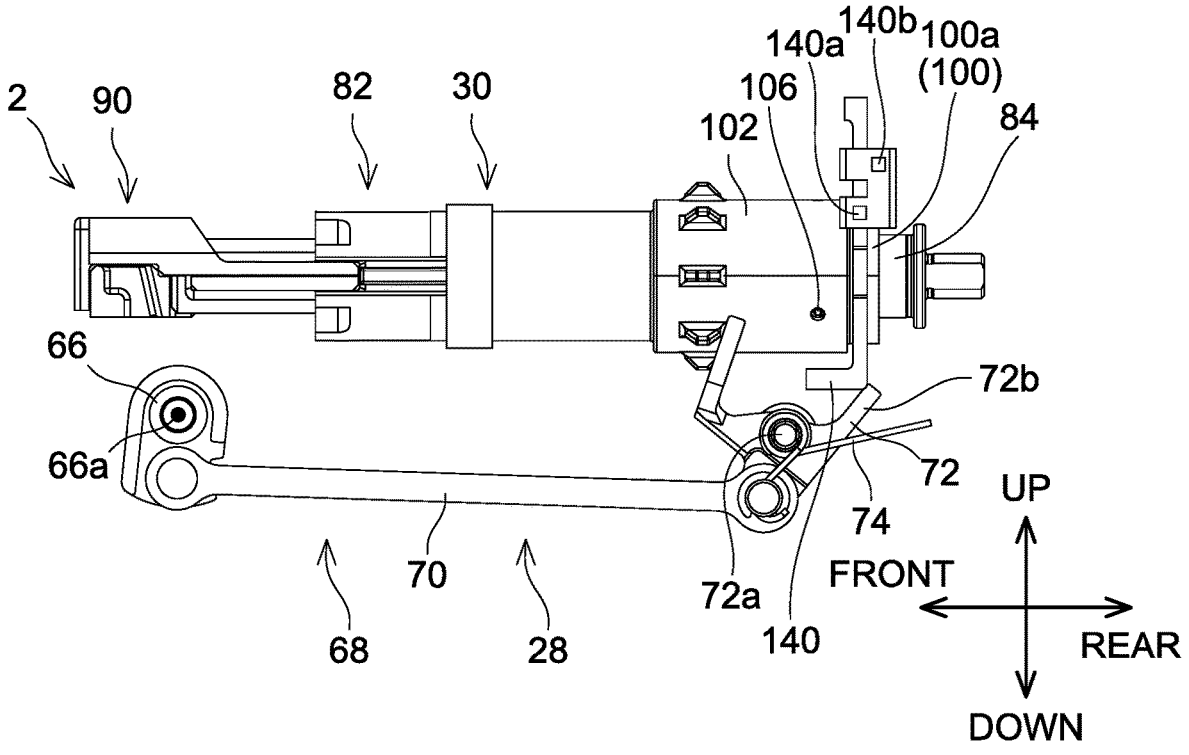
FIG. 6 is a side view of the holder 82 and the cutting mechanism 28 of the rebar tying machine 2 according to the embodiment when the operable member 72 is at a cutting position.

As illustrated in FIGS. 5 and 6, the push plate 140 operates the operable member 72 of the cutting mechanism 28. As illustrated in FIG. 5, the push plate 140 is normally separated from a projection 72*b* of the operable member 72. In this state, the operable member 72 is at the initial position. When the push plate 140 recedes with respect to the screw shaft 84 in response to the rotation of the screw shaft 84, the push plate 140 contacts the projection 72*b* and pushes the operable member 72 rearward. As a result, the operable member 72 rotates about the rotation shaft 72*a*, the link member 70 moves forward, and the cutting member 66 rotates about the rotation shaft 66*a*. The push plate 140 can operate the cutting member 66 by operating the operable member 72. When the operable member 72 rotates to the cutting position as illustrated in FIG. 6, the wire W passing through the inside of the cutting member 66 is cut by the cutting member 66. Then, when the push plate 140 advances with respect to the screw shaft 84 in response to the rotation of the screw shaft 84, the operable member 72 is biased by the biasing member 74 and rotates about the rotation shaft 72*a* to the initial position. As a result, the link member 70 and the cutting member 66 also return to their states illustrated in FIG. 5.

The push plate 140 includes an initial state detecting magnet 140*a* and a grip detecting magnet 140*b*. As illustrated in FIG. 7, the twisting mechanism 30 comprises an initial state detection sensor 136 configured to detect magnetism from the initial state detecting magnet 140*a* and a grip detection sensor 138 configured to detect magnetism from the grip detecting magnet 140*b*. The positions of the initial state detection sensor 136 and the grip detection sensor 138 are fixed with respect to the body 4. When the twisting mechanism 30 is in an initial state, the initial state detection sensor 136 is opposed to the initial state detecting magnet 140*a*. Thus, the initial state detection sensor 136 can detect whether the twisting mechanism 30 is in the initial state or not. When the holder member 90 is in the half open state in the twisting mechanism 30, that is, when the holder member 90 grips the distal end of the wire W, the grip detection sensor 138 is opposed to the grip detecting magnet 140*b*. Thus, the grip detection sensor 138 can detect whether the holder member 90 is gripping the distal end of the wire W in the twisting mechanism 30 or not.

As illustrated in FIG. 7, fins 144 are arranged on an outer surface of the rear portion of the outer sleeve 102. The fins 144 extend in the front-rear direction. The fins 144 permit or prohibit the rotation of the outer sleeve 102. In the present embodiment, eight fins are arranged at intervals of 45 degrees on the outer surface of the outer sleeve 102. Further, in the present embodiment, the fins 144 comprise seven short fins 146 and one long fin 148. The length of the long fin 148 in the front-rear direction is greater than the length of the short fins 146 in the front-rear direction. With respect to the front-rear direction, a front end of the long fin 148 is at the same position as positions of front ends of the short fins 146. To the contrary, with respect to the front-rear direction, a rear end of the long fin 148 is positioned rearward of rear ends of the short fins 146.

Figure 15:
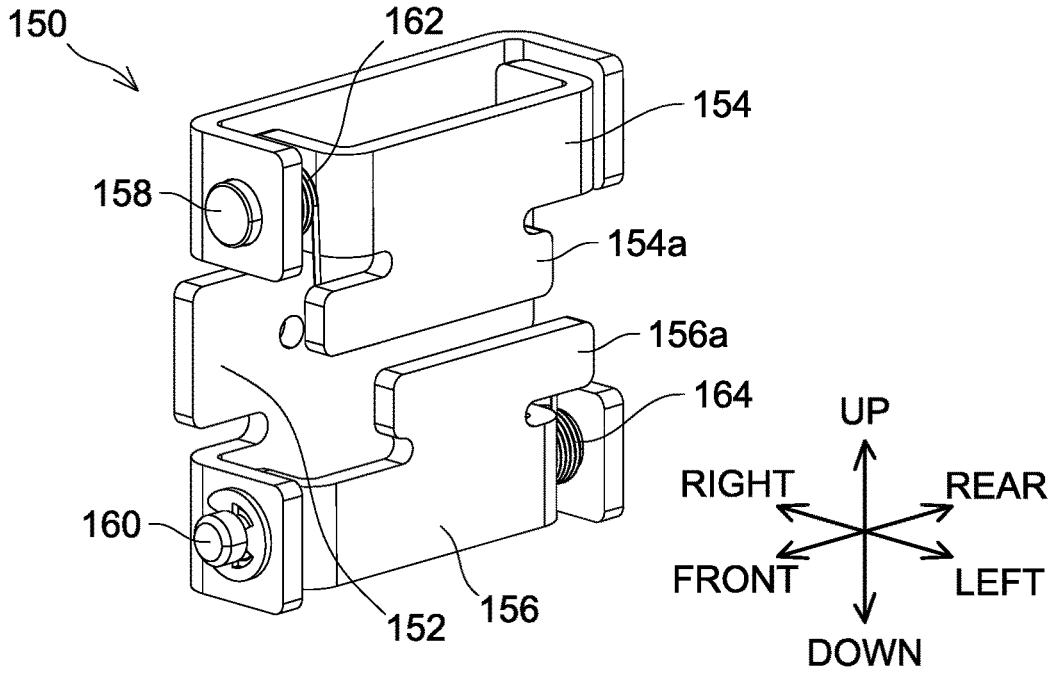
FIG. 15 is a perspective view of a rotation restrictor 1S) of the rebar tying machine 2 according to the embodiment.
Figure 17:
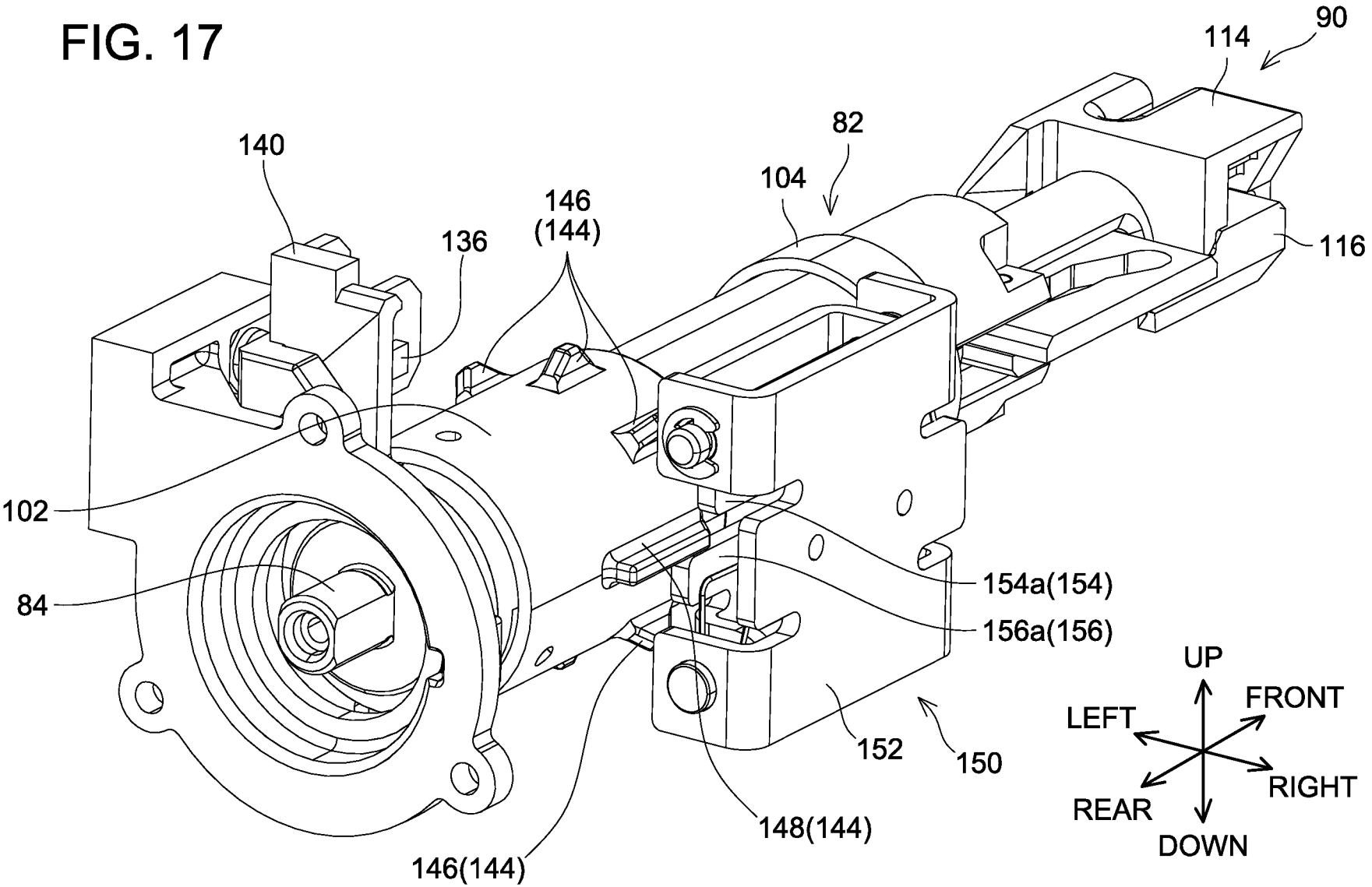
FIG. 17 is a side view of the holder 82 and the rotation restrictor 150 of the rebar tying machine 2 according to the embodiment, with a base member 152 and biasing members 162, 164 removed.

The rebar tying machine 2 further comprises a rotation restrictor 150 illustrated in FIG. 15. As illustrated in FIG. 17, the rotation restrictor 150 is positioned adjacent to the outer sleeve 102. The rotation restrictor 150 permits or prohibits the rotation of the outer sleeve 102 in cooperation with the fins 144. As illustrated in FIG. 15, the rotation restrictor 150 comprises a base member 152, an upper stopper 154, a lower stopper 156, swing shafts 158, 160, and biasing members 162, 164. The base member 152 is fixed to the body 4. The upper stopper 154 is swingably supported by the base member 152 via the swing shaft 158. The upper stopper 154 comprises a restriction piece 154*a*. The restriction piece 154*a* is positioned at a lower portion of the upper stopper 154. The biasing member 162 biases the restriction piece

154*a* in a direction that opens the restriction piece 154*a* outward (i.e., in a direction that brings the restriction piece 154*a* away from the base member 152).

When the screw shaft 84 rotates clockwise as viewed from the rear, the short fins 146 and the long fin 148 push in the restriction piece 154*a*. Thus, the upper stopper 154 does not prohibit the rotation of the outer sleeve 102. To the contrary, when the screw shaft 84 rotates counterclockwise as viewed from the rear, the short fins 146 and the long fin 148 contact the restriction piece 154*a* in the rotation direction of the outer sleeve 102. Thus, the upper stopper 154 prohibits the rotation of the outer sleeve 102. When the screw shaft 84 rotates clockwise as viewed from the rear corresponds to when the twisting mechanism 30 has finished twisting the wire W around the rebars R and returns to its initial state. When the screw shaft 84 rotates counterclockwise as viewed from the rear corresponds to when the twisting mechanism 30 holds and twists the wire W around the rebars R.

The lower stopper 156 is swingably supported by the base member 152 via the swing shaft 160. The lower stopper 156 comprises a restriction piece 156*a*. The restriction piece 156*a* is positioned at an upper portion of the lower stopper 156. The restriction piece 156*a* is opposed to the restriction piece 154*a*. A rear end of the restriction piece 156*a* is positioned rearward of a rear end of the restriction piece 154*a*. A front end of the restriction piece 156*a* is positioned rearward of a front end of the restriction piece 154*a*. The biasing member 164 biases the restriction piece 156*a* in a direction that opens the restriction piece 156*a* outward (i.e., in a direction that brings the restriction piece 156*a* away from the base member 152).

When the screw shaft 84 rotates clockwise as viewed from the rear, the short fins 146 and the long fin 148 contact the restriction piece 156*a* in the rotation direction of the outer sleeve 102. Thus, the lower stopper 156 prohibits the rotation of the outer sleeve 102. To the contrary, when the screw shaft 84 rotates counterclockwise as viewed from the rear, the short fins 146 and the long fin 148 push in the restriction piece 156*a*. Thus, the lower stopper 156 does not prohibit the rotation of the outer sleeve 102.

Regarding the mechanical configuration of the rebar tying machine 2, various changes and modifications may be added to the configuration described above. For example, the reel holder 12 may be positioned at the rear portion of the body 4 and the feed mechanism 24 may be positioned between the reel holder 12 and the guide mechanism 26 of the body 4 in the rebar tying machine 2. In this case, the reel 18, the feed motor 32, and the twisting motor 76 are positioned above the grip 6. Alternatively, the control board 20 and/or the display board 22 may be housed inside the body 4. In this case, the control board 20 and/or the display board 22 are positioned above the grip 6.

(Operation of Rebar Tying Machine 2)

Referring to FIGS. 4, 9, 16, and 17, how the rebar tying machine 2 ties the rebars R with the wire W will be described. To tie the rebars R with the wire W by the rebar tying machine 2, a feeding-out process, a distal end gripping process, a pulling-back process, a proximal end gripping process, a cutting process, a pulling process, and a twisting process are sequentially performed. As illustrated in FIG. 9, in an initial state in which the rebar tying machine 2 has not started an operation of tying the rebars R with the wire W yet, only the front portion of the screw shaft 84 is inserted within the inner sleeve 100. Further, the long fin 148 is positioned between the restriction piece 154*a* of the upper stopper 154 and the restriction piece 156*a* of the lower stopper 156. Further, the outer sleeve 102 is at the advance position with respect to the clamp guide 86. The two guide pins 110 are positioned in the front portions of the two upper guide holes 118*a* and the two lower guide holes 126*a*, and the holder member 90 is in the fully open state. As illustrated in FIG. 5, the push plate 140 is separated from the projection 72*b* of the operable member 72 and the operable member 72 is at the initial position.

(Feeding-Out Process)

When the feed motor 32 rotates in reverse in the initial state, the feed mechanism 24 feeds out a predetermined length of the wire W wound on the reel 18. The distal end of the wire W sequentially passes through the inside of the cutting member 66, the first wire path 124, the upper guide path 58*a*, the lower guide path 60*a*, and the second wire path 132. As a result, the wire W is arranged around the rebars R in a loop shape as illustrated in FIG. 4.

(Distal End Gripping Process)

When the twisting motor 76 rotates forward in that state, the screw shaft 84 rotates counterclockwise. The long fin 148 contacts the restriction piece 154*a* of the upper stopper 154 in the rotation direction of the outer sleeve 102, and thus the counterclockwise rotation of the outer sleeve 102 is prohibited. Thus, the outer sleeve 102 recedes with respect to the clamp guide 86, along with the inner sleeve 100. As the outer sleeve 102 recedes, the two guide pins 110 move from the front portions to the intermediate positions within the two upper guide holes 118*a* and the two lower guide holes 126*a*. The holder member 90 transitions from the fully open state to the half open state, and a portion of the wire W that is near the distal end (i.e., the first held portion WP1) is held and fixed at the first holding site P1 between the second upper projection 122 and the first lower projection 128. Thus, the portion of the wire W that is near the distal end is held by the holder member 90. In this state, the first retainer 123 blocks the first holding site P1 of the holder member 90 from the front.

(Pulling-Back Process)

When the twisting motor 76 stops and the feed motor 32 rotates forward in that state, the feeder 36 pulls back the wire W around the rebars R. Since the portion of the wire W that is near the distal end is held by the holder member 90, the diameter of the loop formed by the wire W around the rebars R is reduced.

(Proximal End Gripping Process)

When the twisting motor 76 rotates forward again in that state, the outer sleeve 102 further recedes with respect to the clamp guide 86, along with the inner sleeve 100. As the outer sleeve 102 recedes, the two guide pins 110 move from the intermediate positions to the rear portions within the two upper guide holes 118*a* and the two lower guide holes 126*a*. The holder member 90 transitions from the half open state to the fully closed state, and a portion of the wire W that is near the proximal end (i.e., the second held portion WP2) is held and fixed at the second holding site P2 between the first upper projection 120 and the second lower projection 130. Thus, the portion of the wire W that is near the proximal end is held by the holder member 90. In this state, the first retainer 123 blocks the first holding site P1 of the holder member 90 from the front and the second retainer 131 is positioned immediately below the second holding site P2 of the holder member 90. Further, the first retainer 123 and the second retainer 131 are positioned between the rebars R and the wire W.

(Cutting Process)

As the twisting motor 76 rotates forward in that state, the outer sleeve 102 further recedes with respect to the clamp guide 86. As illustrated in FIG. 6, the push plate 140 recedes along with the outer sleeve 102, contacts the projection 72*b* of the operable member 72, and pushes it rearward. When the operable member 72 rotates about the rotation shaft 72*a* to the cutting position, the cutting member 66 rotates about the rotation shaft 66*a* to a predetermined position. The wire W passing through the inside of the cutting member 66 is thereby cut. The wire W around the rebars R is held by the holder member 90 at the portion of the wire W that is near the distal end and the portion thereof that is near the proximal end.

(Pulling Process)

Figure 16:
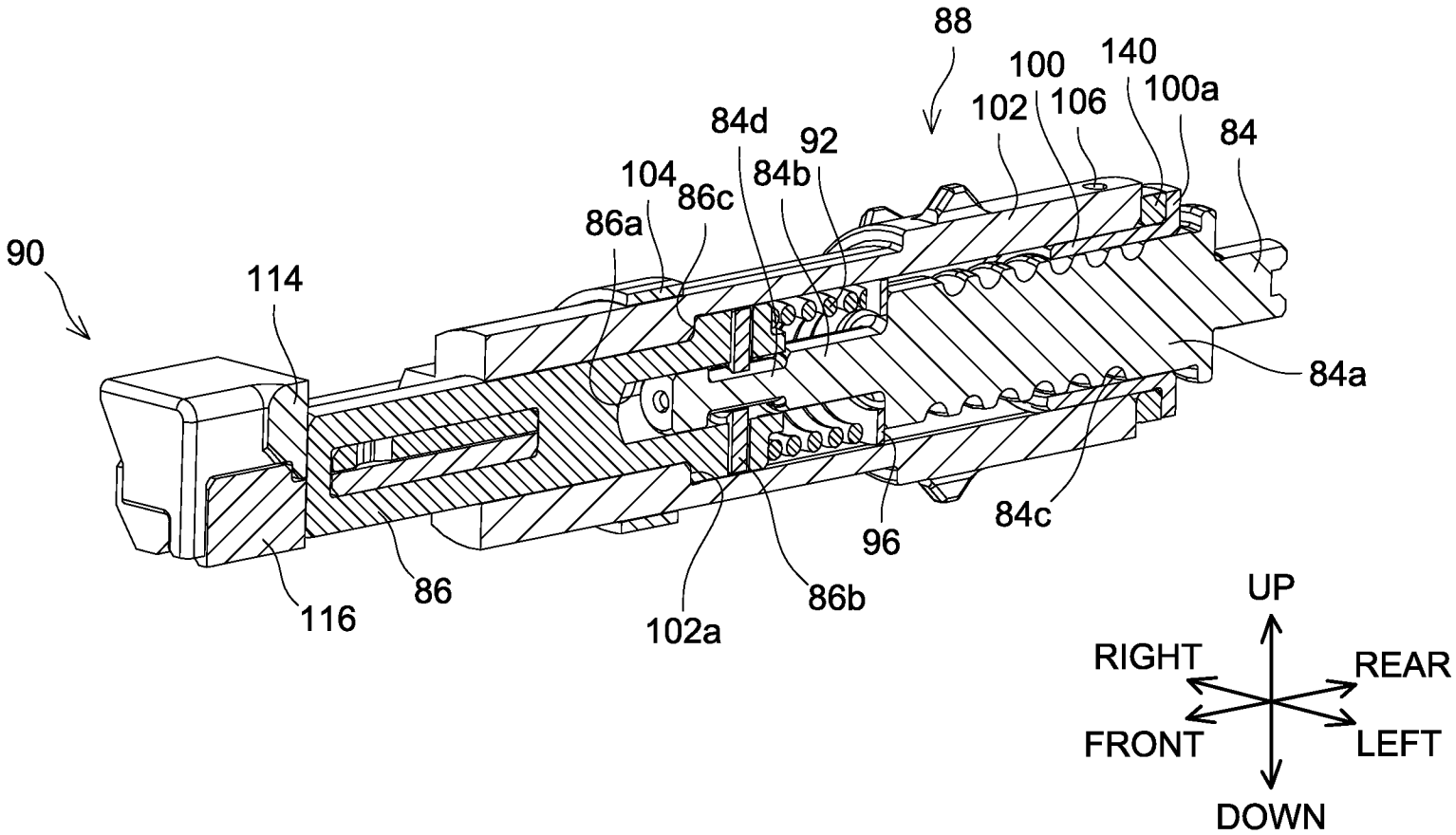
FIG. 16 is a perspective sectional view of the holder 82 of the rebar tying machine 2 according to the embodiment when a step 102*a* of the outer sleeve 102 is in contact with a step 86*c* of the clamp guide 86.

When the outer sleeve 102 further recedes with respect to the clamp guide 86 in that state in response to the forward rotation of the twisting motor 76, the step 102*a* of the outer sleeve 102 contacts the step 86*c* of the clamp guide 86 as illustrated in FIG. 16. The outer sleeve 102 thereby cannot recede any more with respect to the clamp guide 86 and thus recedes integrally with the clamp guide 86. As a result, the holder member 90 recedes (i.e., the holder member 90 moves away from the rebars R) and the wire W around the rebars R is pulled away from the rebars R. While the pulling process is performed, the first retainer 123 blocks the first holding site P1 from the front and the second retainer 131 is positioned immediately below and forward of the second holding site P2. Thus, when the wire W moves forward with respect to the holder member 90 due to the tension applied to the wire W as the wire W is pulled, the portion WP1 of the wire W that is near the distal end contacts the first retainer 123 and the portion WP2 of the wire W that is near the proximal end contacts the second retainer 131. The wire W is thus pulled away from the rebars R without slipping out of the holder member 90.

(Twisting Process)

In the state, when the outer sleeve 102 recedes along with the clamp guide 86 in response to the forward rotation of the twisting motor 76, the long fin 148 comes out of contact with the restriction piece 154*a* of the upper stopper 154 in the rotation direction of the outer sleeve 102 as illustrated in FIG. 17. This permits the counterclockwise rotation of the outer sleeve 102. In this state, the biasing member 92 is compressed and applies to the clamp guide 86 a biasing force that brings the clamp guide 86 away from the washer 96. Thus, frictional forces act between the balls 94 fitted in the ball holes of the inner sleeve 100 and the ball groove 84*c* of the screw shaft 84. Consequently, when the clamp guide 86 rotates, the outer sleeve 102 does not recede with respect to the screw shaft 84 but rotates counterclockwise integrally with the screw shaft 84. As a result, the clamp guide 86 and the holder member 90 rotate counterclockwise, and thus the wire W held by the holder member 90 is twisted. While the twisting process is performed, as in the pulling process, the first retainer 123 blocks the first holding site P1 from the front and the second retainer 131 is positioned immediately below and forward of the second holding site P2. Thus, when the wire W moves forward with respect to the holder member 90 due to the tension applied to the wire W as the wire W is twisted, the portion WP1 of the wire W that is near the distal end contacts the first retainer 123 and the portion WP2 of the wire W that is near the proximal end contacts the second retainer 131. The wire W is thus twisted without slipping out of the holder member 90.

(Initial State Returning Process)

Thereafter, the twisting motor 76 rotates in reverse and the screw shalt 84 rotates clockwise. The outer sleeve 102 rotates clockwise and one of the short fins 146 or the long fin 148 contacts the restriction piece 156*a* of the lower stopper 156, and thus the clockwise rotation of the outer sleeve 102 is prohibited. Since the biasing member 92 is applying to the clamp guide 86 the biasing force that brings the clamp guide 86 away from the washer 96, the outer sleeve 102 advances along with the clamp guide 86. When the engagement pin 86*b* contacts the front end of the engagement groove 84*d*, the outer sleeve 102 advances with respect to the clamp guide 86. When the two guide pins 110 have moved within the two upper guide holes 118*a* and the two lower guide holes 126*a* from their rear portions to front portions, the holder member 90 transitions to the fully open state. This allows the wire W held by the holder member 90 to be released from the holder member 90. In a case where the short fin 146 is in contact with the restriction piece 156*a*, when the outer sleeve 102 advances with respect to the clamp guide 86 and the short fin 146 moves forward than the front end of the restriction piece 156*a*, the outer sleeve 102 rotates clockwise again. When the long fin 148 is in contact with the restriction piece 156*a*, the rotation of the outer sleeve 102 is prohibited. The twisting mechanism 30 thereby returns to its initial state.

(Circuit Configuration of Control Board 20)

Figure 20:
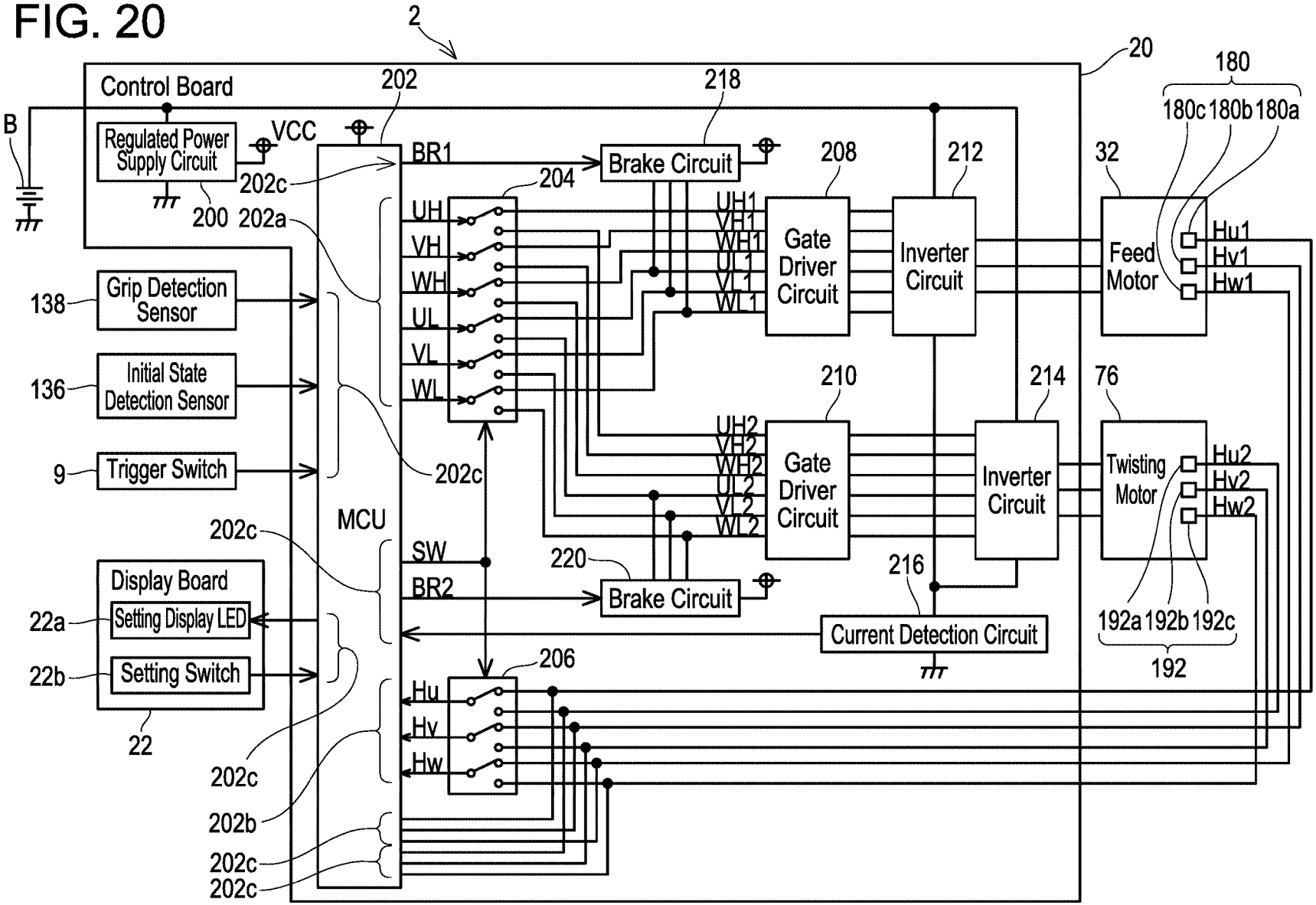
FIG. 20 is a diagram illustrating a circuit configuration of a control board 20 of the rebar tying machine 2 according to the embodiment.

As illustrated in FIG. 20, the control board 20 comprises a regulated power supply circuit 200, an MCU (micro control unit) 202, a motor control signal output switching circuit 204, a motor rotation signal input switching circuit 206, gate driver circuits 208, 210, inverter circuits 212, 214, a current detection circuit 216, brake circuits 218, 220, etc.

The regulated power supply circuit 200 adjusts the electric power supplied from the battery B to a predetermined voltage and supplies the electric power to the MCU 202, brake circuits 218, 220, etc.

Figure 21:
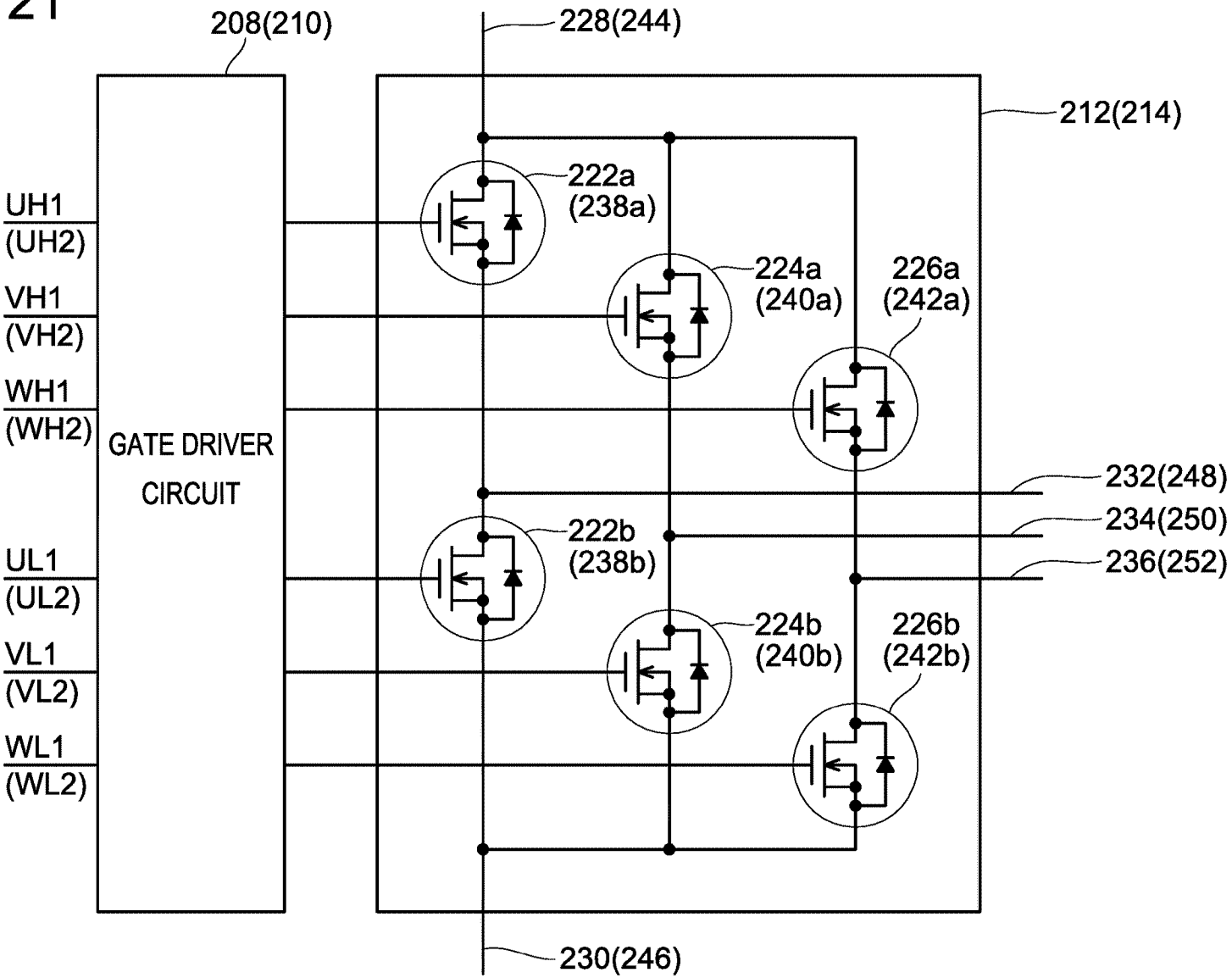
FIG. 21 is a diagram illustrating an exemplary circuit configuration of inverter circuits 212, 214 of the rebar tying machine 2 according to the embodiment.

As illustrated in FIG. 21, the inverter circuit 212 comprises switching elements 222*a*, 222*b*, 224*a*, 224*b*, 226*a*, 226*b*. Each of the switching elements 222*a*, 222*b*, 224*a*, 224*b*, 226*a*, 226*b* is a field-effect transistor, specifically a MOSFET including an insulated gate. The switching element 222*a* connects a positive-side potential line 228 to a motor power line 232. The switching element 222*b* connects a negative-side potential line 230 to the motor power line 232. The switching element 224*a* connects the positive-side potential line 228 to a motor power line 234. The switching element 224*b* connects the negative-side potential line 230 to the motor power line 234. The switching element 226*a* connects the positive-side potential line 228 to a motor power line 236. The switching element 226*b* connects the negative-side potential line 230 to the motor power line 236. The positive-side potential line 228 is connected to a positive-side power potential of the battery B. The negative-side potential line 230 is connected to the current detection circuit 216. The motor power lines 232, 234, 236 are connected to the coils 170 of the feed motor 32 (see FIGS. 18, 19).

Similarly, the inverter circuit 214 comprises switching elements 238*a*, 238*b*, 240*a*, 240*b*, 242*a*, 242*b*. Each of the switching elements 238*a*, 238*b*, 240*a*, 240*b*, 242*a*, 242*b* is a field-effect transistor, specifically a MOSFET including an insulated gate. The switching element 238*a* connects a positive-side potential line 244 to a motor power line 248. The switching element 238*b* connects a negative-side potential line 246 to the motor power line 248. The switching element 240*a* connects the positive-side potential line 244 to a motor power line 250. The switching element 240*b* connects the negative-side potential line 246 to the motor power line 250. The switching element 242*a* connects the positive-side potential line 244 to a motor power line 252. The switching element 242*b* connects the negative-side potential line 246 to the motor power line 252. The positive-side potential line 244 is connected to the positive-side power potential of the battery B. The negative-side potential line 246 is connected to the current detection circuit 216. The motor power lines 248, 250, 252 are connected to the coils 182 of the twisting motor 76 (see FIGS. 18, 19).

The gate driver circuit 208 controls the operation of the feed motor 32 by switching the switching elements 222*a*, 224*a*, 226*a*, 222*b*, 224*b*, 226*b* of the inverter circuit 212 between a conducting state and a non-conducting state according to motor control signals UH1, VH1, WH1, UL1, VL1, WL1. When the gate driver circuit 208 switches all of the switching elements 222*a*, 224*a*, 226*a*, 222*b*. 224*b*, 226*b* to the non-conducting state while the feed motor 32 is rotating, the power supply to the feed motor 32 is cut off, and thus the feed motor 32 stops after continuing to rotate fora while according to inertia. To the contrary, when the gate driver circuit 208 switches the switching elements 222*a*, 224*a*, 226*a* to the non-conducting state and the switching elements 222*b*, 224*b*, 226*b* to the conducting state while the feed motor 32 is rotating, a so-called short-circuit brake is applied to the feed motor 32, and thus the rotation of the feed motor 32 stops immediately. Hereinafter, the motor control signals UH1, VH1, WH1, UL1, VL1, WL1 in which UL1, VL1, WL1 all have an H potential (in this case, the switching elements 222*b*, 224*b*, 226*b* are all switched to the conducting state) may be termed a short-circuit brake signal.

Similarly, the gate driver circuit 210 controls the operation of the twisting motor 76 by switching the switching elements 238*a*, 240*a*, 242*a*, 238*b*, 240*b*, 242*b* of the inverter circuit 214 between a conducting state and a non-conducting state according to motor control signals UH2, VH2, WH2, UL2, VL2, WL2. When the gate driver circuit 210 switches all of the switching elements 238*a*, 240*a*, 242*a*, 238*b*, 240*b*, 242*b* to the non-conducting state while the twisting motor 76 is rotating, the power supply to the twisting motor 76 is cut off, and thus the twisting motor 76 stops after continuing to rotate for a while according to inertia. To the contrary, when the gate driver circuit 210 switches the switching elements 238*a*, 240*a*, 242*a* to the non-conducting state and the switching elements 238*b*, 240*b*, 242*b* to the conducting state while the twisting motor 76 is rotating, a so-called short-circuit brake is applied to the twisting motor 76, and thus the rotation of the twisting motor 76 stops immediately. Hereinafter, the motor control signals UH2, VH2, WH2, UL2, VL2, WL2 in which UL2, VL2, WL2 all have the H potential (in this case, the switching elements 238*b*, 240*b*, 242*b* are all switched to the conducting state) may be termed a short-circuit brake signal.

As illustrated in FIG. 20, the current detection circuit 216 is disposed between the negative-side power potential of the battery B and the inverter circuits 212, 214. The current detection circuit 216 detects magnitudes of currents flowing through the inverter circuits 212, 214. The current detection circuit 216 outputs detected current values to the MCU 202.

The MCU 202 comprises motor control signal output ports 202*a*, motor rotation signal input ports 202*b*, and general-purpose input-output ports 202*c*. The motor control signal output ports 202*a* are for output of motor control signals UH, VH, WH, UL, VL, WL to the brushless motors and are capable of processing signals faster than the general-purpose input-output ports 202*c*. The motor rotation signal input ports 202*b* are for input of Hall sensor signals Hu, Hv, Hw from the brushless motors and are capable of processing signals faster than the general-purpose input-output ports 202*c*. The setting display LED 22*a* and the setting switch 22*b* of the display board 22, the trigger switch 9, the initial state detection sensor 136, the grip detection sensor 138, and the current detection circuit 216 are connected to the general-purpose input-output ports 202*c* of the MCU 202.

The motor control signal output ports 202*a* of the MCU 202 are connected to the motor control signal output switching circuit 204. The motor control signal output switching circuit 204 switches output destinations of the motor control signals UH, VH, WH, UL. VL, WL outputted from the motor control signal output ports 202*a* between the gate driver circuit 208 and the gate driver circuit 210 according to a switching signal SW outputted from the general-purpose input-output port 202*c* of the MCU 202.

Figure 22:
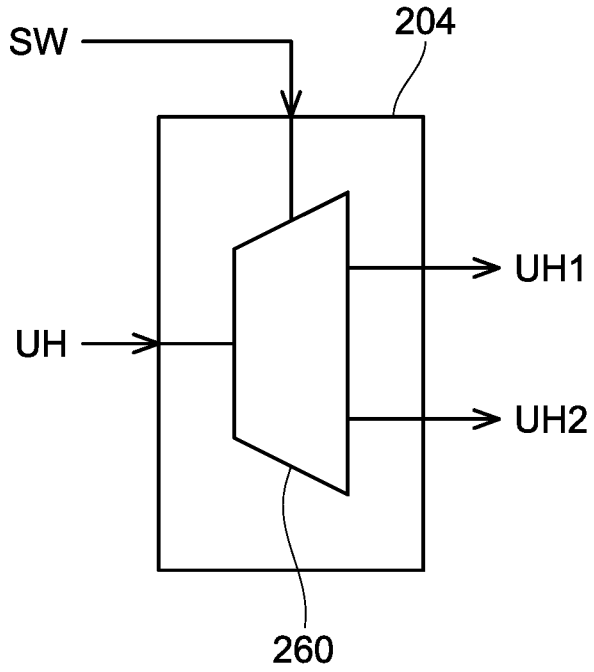
FIG. 22 is a diagram illustrating an exemplary circuit configuration of a motor control signal output switching circuit 204 of the rebar tying machine 2 according to the embodiment.

As illustrated in FIG. 22, the motor control signal output switching circuit 204 may comprise a demultiplexer 260. When the switching signal SW outputted from the MCU 202 has the H potential, the demultiplexer 260 outputs the motor control signal UH outputted from the MCI 202 to the gate driver circuit 208 as the motor control signal UH1. When the switching signal SW outputted from the MCU 202 has an L, potential, the demultiplexer 260 outputs the motor control signal UH outputted from the MCU 202 to the gate driver circuit 210 as the motor control signal UH2. In order to facilitate the understanding, the details have been described only for the motor control signal UH, however, the motor control signal output switching circuit 204 operates the same for the other motor control signals VH, WH, UL, VL, WL, as well.

Figure 23:
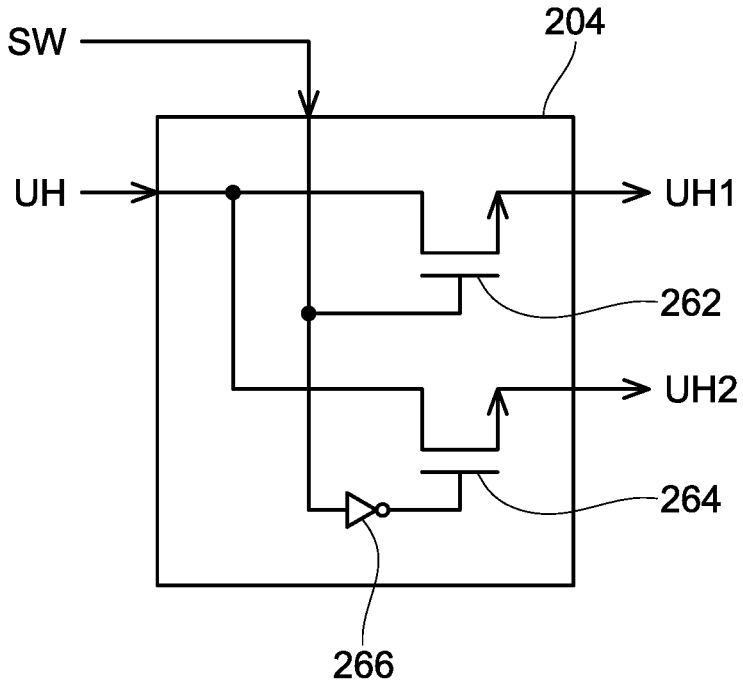
FIG. 23 is a diagram illustrating another exemplary circuit configuration of the motor control signal output switching circuit 204 of the rebar tying machine 2 according to the embodiment.

Alternatively, as illustrated in FIG. 23, the motor control signal output switching circuit 204 may comprise FETs 262, 264 and a NOT gate 266. When the switching signal SW outputted from the MCU 202 has the H potential, the FET 262 is turned on and the FET 264 is turned off. In this case, the motor control signal output switching circuit 204 outputs the motor control signal UH outputted from the MCU 202 to the gate driver circuit 208 as the motor control signal UH1. When the switching signal SW outputted from the MCU 202 has the L potential, the FET 262 is turned off and the FET 264 is turned on. In this case, the motor control signal output switching circuit 204 outputs the motor control signal UH outputted from the MCU 202 to the gate driver circuit 210 as the motor control signal UH2. In order to facilitate the understanding, the details have been described only for the motor control signal UH, however, the motor control signal output switching circuit 204 operates the same for the other motor control signals VH, WH, UL, V L, WL, as well.

Figure 24:
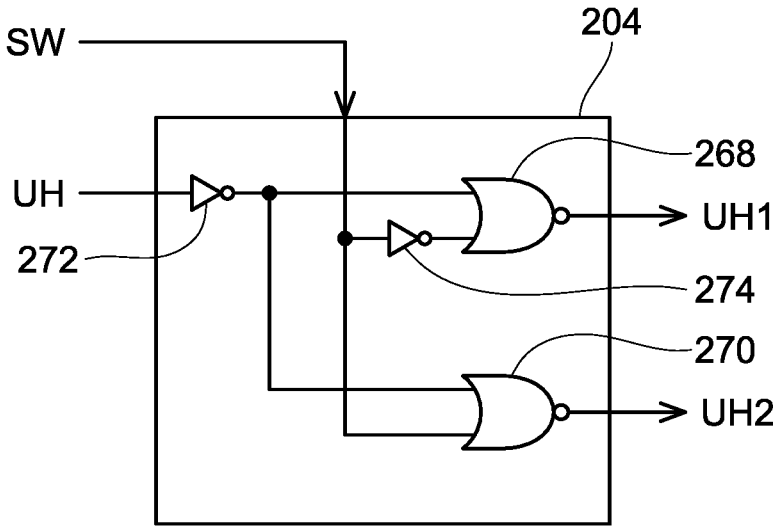
FIG. 24 is a diagram illustrating yet another exemplary circuit configuration of the motor control signal output switching circuit 204 of the rebar tying machine 2 according to the embodiment.

Alternatively, as illustrated in FIG. 24, the motor control signal output switching circuit 204 may comprise NOR gates 268, 270 and NOT gates 272, 274. When the switching signal SW outputted from the MCU 202 has the H potential, the NOR gate 268 outputs the motor control signal UH outputted from the MCU 202 and the NOR gate 270 outputs the L potential. In this case, the motor control signal output switching circuit 204 outputs the motor control signal UH outputted from the MCU 202 to the gate driver circuit 208 as the motor control signal UH1. When the switching signal SW outputted from the MCU 202 has the L potential, the NOR gate 268 outputs the L potential and the NOR gate 270 outputs the motor control signal UH outputted from the MCU 202. In this case, the motor control signal output switching circuit 204 outputs the motor control signal UH outputted from the MCU 202 to the gate driver circuit 210 as the motor control signal UH2. In order to facilitate the understanding, the details have been described only for the motor control signal UH, however, the motor control signal output switching circuit 204 operates the same for the other motor control signals VH, WH, UL, VL, WL as well.

Figure 25:
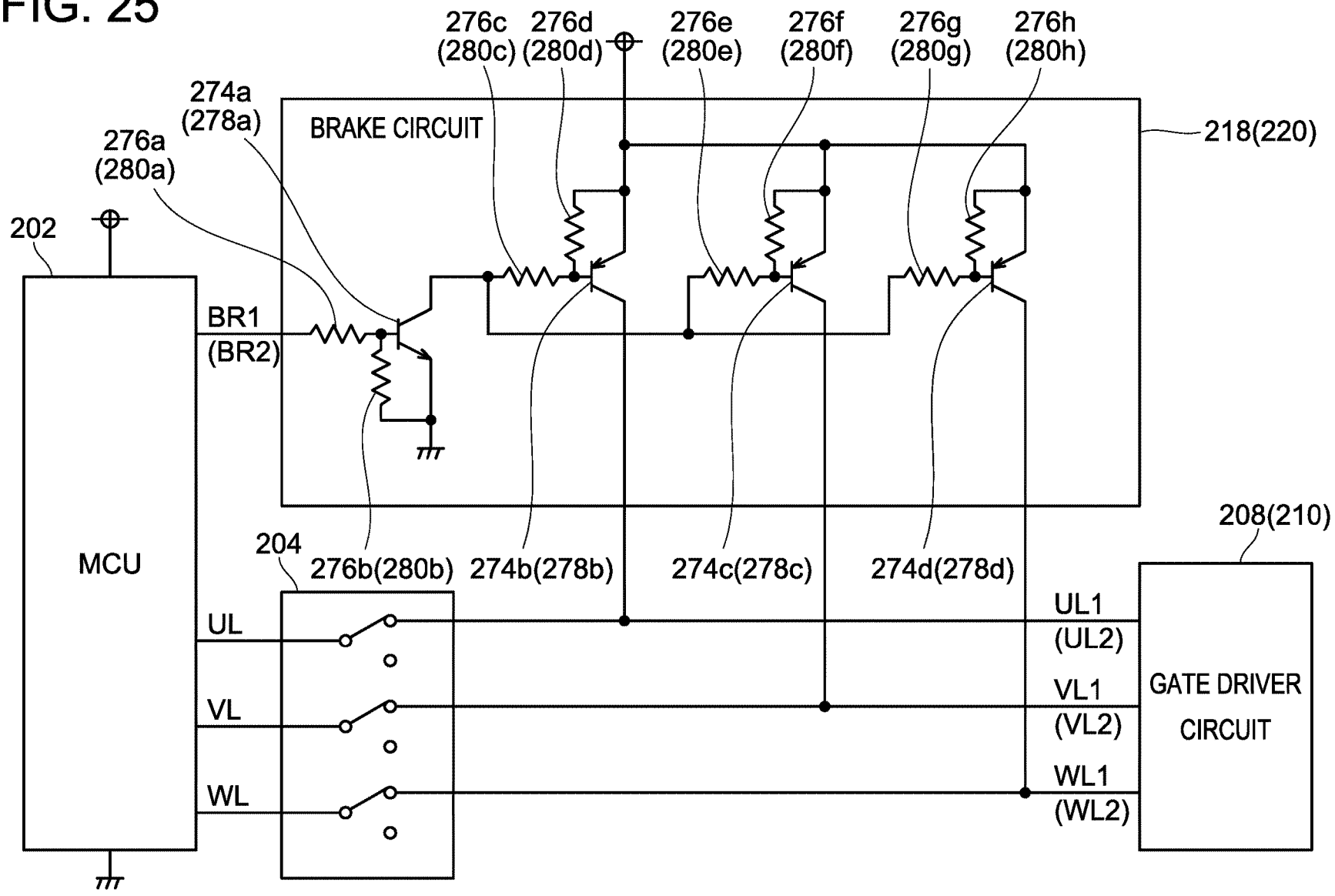
FIG. 25 is a diagram illustrating a circuit configuration of brake circuits 218, 220 of the rebar tying machine 2 according to the embodiment.

As illustrated in FIG. 25, the brake circuit 218 is connected to signal lines for the motor control signals UL1, VL1, WL1 that are outputted from the motor control signal output switching circuit 204 to the gate driver circuit 208. The brake circuit 218 applies the short-circuit brake on the feed motor 32 according to a brake signal BR1 outputted from the general-purpose input-output port 202*c* of the MCU 202. The brake circuit 218 comprises transistors 274*a*, 274*b*, 274*c*, 274*d* and resistors 276*a*, 276*b*, 276*c*, 276*d*, 276*e*, 276*f*, 276*g*, 276*h*. When the brake signal BR1 inputted from the MCU 202 has the L potential, the transistor 274*a* is turned off and all the transistors 274*b*, 274*c*, 274*d* are thus turned off. As a result, the motor control signals UL1, VL1, WL1 outputted from the motor control signal output switching circuit 204 are inputted to the gate driver circuit 208 without being changed. When the brake signal BR1 inputted from the MCU 202 has the H potential, the transistor 274*a* is turned on and all the transistors 274*b*, 274*c*, 274*d* are thus turned on. As a result, the motor control signals UL1, VL1, WL1 to be inputted to the gate driver circuit 208 all have the H potential. In this case, the short-circuit brake signal is inputted to the gate driver circuit 208 and the short-circuit brake is applied on the feed motor 32.

Similarly, the brake circuit 220 is connected to signal lines for the motor control signals UL2, VL2, WL2 that are outputted from the motor control signal output switching circuit 204 to the gate driver circuit 210. The brake circuit 220 applies the short-circuit brake on the twisting motor 76 according to a brake signal BR2 outputted from the general-purpose input-output port 202*c* of the MCU 202. The brake circuit 220 comprises a similar configuration to that of the brake circuit 218. The brake circuit 220 comprises transistors 278*a*, 278*b*, 278*c*, 278*d* and resistors 280*a*, 280*b*, 280*c*, 280*d*, 280*e*, 280*f*, 280*g*, 280*h*. When the brake signal BR2 inputted from the MCU 202 has the L potential, the transistor 278*a* is turned off and all the transistors 278*b*, 278*c*, 278*d* are thus turned off. As a result, the motor control signals UL2, VL2, WL2 outputted from the motor control signal output switching circuit 204 are inputted to the gate driver circuit 210 without being changed. When the brake signal BR2 inputted from the MCU 202 has the H potential, the transistor 278*a* is turned on and all the transistors 278*b*, 278*c*, 278*d* are thus turned on. As a result, the motor control signals UL2, VL2, WL2 to be inputted to the gate driver circuit 210 all have the H potential. In this case, the short-circuit brake signal is inputted to the gate driver circuit 210 and the short-circuit brake is applied on the twisting motor 76.

As illustrated in FIG. 20, the Hall sensor 180 of the feed motor 32 and the Hall sensor 192 of the twisting motor 76 are connected to the motor rotation signal input switching circuit 206. The motor rotation signal input switching circuit 206 is connected to the motor rotation signal input ports 202*b* of the MCU 202. The motor rotation signal input switching circuit 206 inputs one of a group of Hall sensor signals Hu1, Hv1, Hw1 from the feed motor 32 and a group of Hall sensor signals Hu2, Hv2, Hw2 from the twisting motor 76 to the motor rotation signal input ports 202*b* of the MCU 202 according to the switching signal SW outputted from the MCU 202.

Figure 26:
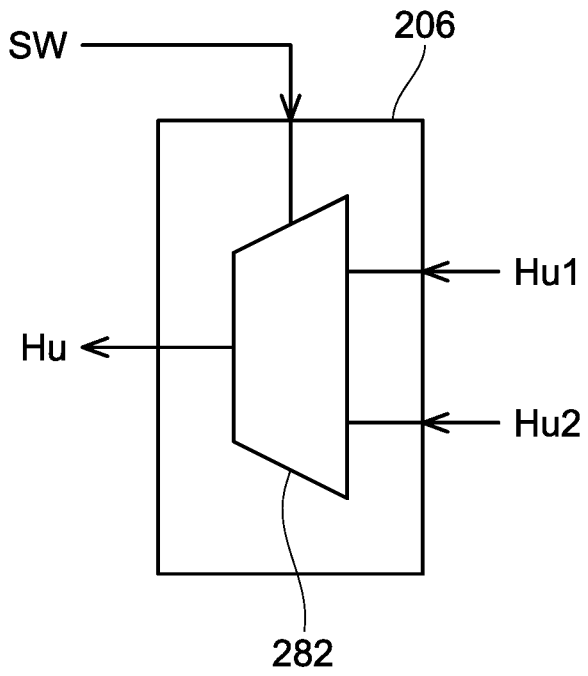
FIG. 26 is a diagram illustrating an exemplary circuit configuration of a motor rotation signal input switching circuit 206 of the rebar tying machine 2 according to the embodiment.

As illustrated in FIG. 26, the motor rotation signal input switching circuit 206 may comprise a multiplexer 282. When the switching signal SW outputted from the MCU 202 has the H potential, the multiplexer 282 outputs the Hall sensor signal Hu1 from the feed motor 32 to the MCU 202 as the Hall sensor signal Hu. When the switching signal SW outputted from the MCU 202 has the L potential, the multiplexer 282 outputs the Hall sensor signal Hu2 from the twisting motor 76 to the MCU 202 as the Hall sensor signal Hu. In order to facilitate the understanding, the details have been described only for the Hall sensor signal Hu, however, the motor rotation signal input switching circuit 206 operates the same for the other Hall sensor signals Hv, Hw, as well.

Figure 27:
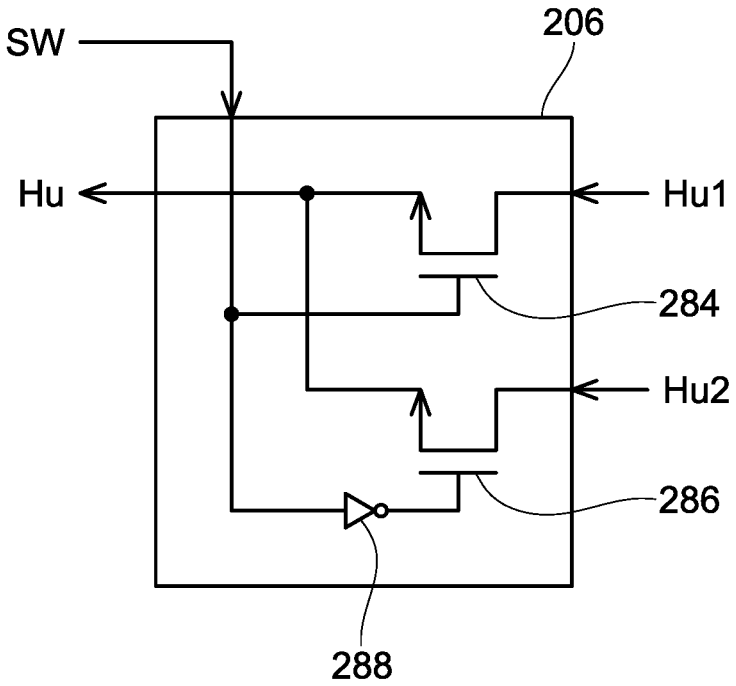
FIG. 27 is a diagram illustrating another exemplary circuit configuration of the motor rotation signal input switching circuit 206 of the rebar tying machine 2 according to the embodiment.

Alternatively, as illustrated in FIG. 27, the motor rotation signal input switching circuit 206 may comprise FETs 284, 286 and a NOT gate 288. When the switching signal SW outputted from the MCU 202 has the H potential, the FET 284 is turned on and the FET 286 is turned off. In this case, the motor rotation signal input switching circuit 206 outputs the Hall sensor signal Hut from the feed motor 32 to the MCU 202 as the Hall sensor signal Hu. When the switching signal SW outputted from the MCU 202 has the L potential, the FET 284 is turned off and the FET 286 is turned on. In this case, the motor rotation signal input switching circuit 206 outputs the Hall sensor signal Hu2 from the twisting motor 76 to the MCU 202 as the Hall sensor signal Hu. In order to facilitate the understanding, the details have been described only for the Hall sensor signal Hu, however, the motor rotation signal input switching circuit 206 operates the same for the other Hall sensor signals Hv, Hw, as well.

Figure 28:
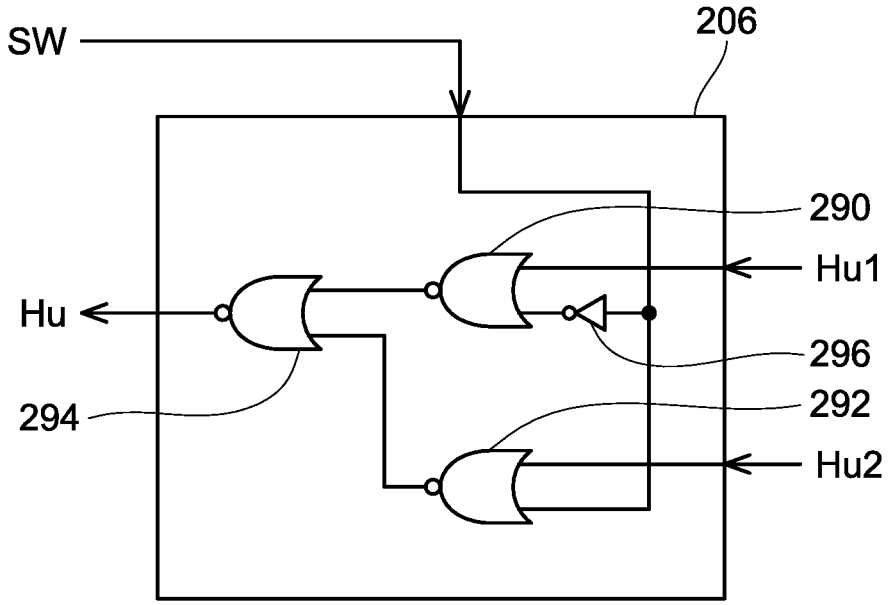
FIG. 28 is a diagram illustrating yet another exemplary circuit configuration of the motor rotation signal input switching circuit 206 of the rebar tying machine 2 according to the embodiment.

Alternatively, as illustrated in FIG. 28, the motor rotation signal input switching circuit 206 may comprise NOR gates 290, 292, 294 and a NOT gate 296. When the switching signal SW outputted from the MCU 202 has the H potential, the NOR gate 290 inverts the Hall sensor signal Hu1 from the feed motor 32 and outputs it and the NOR gate 292 outputs the L potential. As a result, the NOR gate 294 outputs the Hall sensor signal Hu1 from the feed motor 32. In this case, the motor rotation signal input switching circuit 206 outputs the Hall sensor signal Hu1 from the feed motor 32 to the MCU 202 as the Hall sensor signal Hu. When the switching signal SW outputted from the MCU 202 has the L potential, the NOR gate 290 outputs the L potential and the NOR gate 292 inverts the Hall sensor signal Hu2 from the twisting motor 76 and outputs it. As a result, the NOR gate 294 outputs the Hall sensor signal Hu2 from the twisting motor 76. In this case, the motor rotation signal input switching circuit 206 outputs the Hall sensor signal Hu2 from the twisting motor 76 to the MCU 202 as the Hall sensor signal Hu. In order to facilitate the understanding, the details have been described only for the Hall sensor signal flu, however, the motor rotation signal input switching circuit 206 operates the same for the other Hall sensor signals Hv, Hw, as well.

As illustrated in FIG. 20, the Hall sensor 180 of the feed motor 32 and the Hall sensor 192 of the twisting motor 76 are connected to the general-purpose input-output ports 202*c* of the MCU 202, as well. The MCU 202 can monitor the Hall sensor signals Hu1, Hv1, Hw1 and the Hall sensor signals Hu2, Hv2, Hw2 inputted to the general-purpose input-output ports 202*c* from the feed motor 32 and the twisting motor 76.

(Processes Executed by MCU 202)

Figure 29:
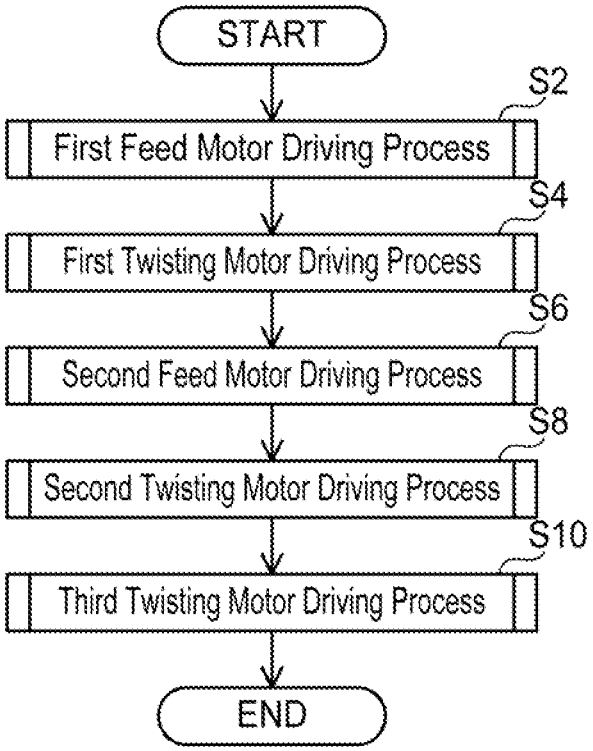
FIG. 29 is a flowchart of a process executed by an MCU 202 of the rebar tying machine 2 according to the embodiment.

The MCU 202 executes the process illustrated in FIG. 29 when the trigger switch 9 is switched from off to on. In the process of FIG. 29, the MCU 202 sequentially executes a first feed motor driving process in S2 (see FIG. 30), a first twisting motor driving process in S4 (see FIG. 31), a second feed motor driving process in S6 (see FIG. 32), a second twisting motor driving process in S8 (see FIG. 35), and a third twisting motor driving process in S10 (see FIG. 36).

(First Feed Motor Driving Process)

Figure 30:
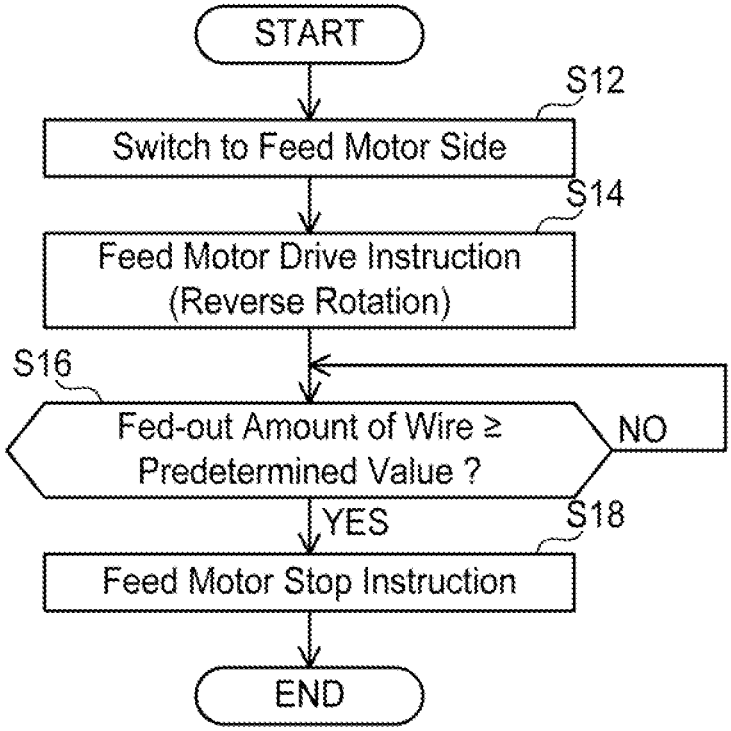
FIG. 30 is a flowchart illustrating details of a first feed motor driving process in S2 of FIG. 29.

Referring to FIG. 30, the first feed motor driving process will be described. In S12, the MCU 202 outputs the H potential as the switching signal SW to switch the motor control signal output switching circuit 204 and the motor rotation signal input switching circuit 206 to the feed motor 32 side.

In S14, the MCU 202 outputs the motor control signals UH, VH, WH, UL, VL, WL to rotate the feed motor 32 in reverse. As a result, the feed motor 32 rotates in reverse and the feeding-out process in which the wire W is fed out starts.

In S16, the MCU 202 waits until a fed-out amount of the wire W reaches a predetermined value. The fed-out amount of the wire W can be calculated, for example, by counting the Hall sensor signals Hu, Hv, Hw. When the fed-out amount of the wire W reaches the predetermined value (YES), the process proceeds to S18.

In S18, the MCU 202 outputs the short-circuit brake signal as the motor control signals UH, VH, WH, UL, VL, WL to stop the feed motor 32. Further, the MCU 202 outputs the H potential as the brake signal BR1. Thus, the feed motor 32 is braked. After S18, the process of FIG. 30 ends.

(First Twisting Motor Driving Process)

Figure 31:
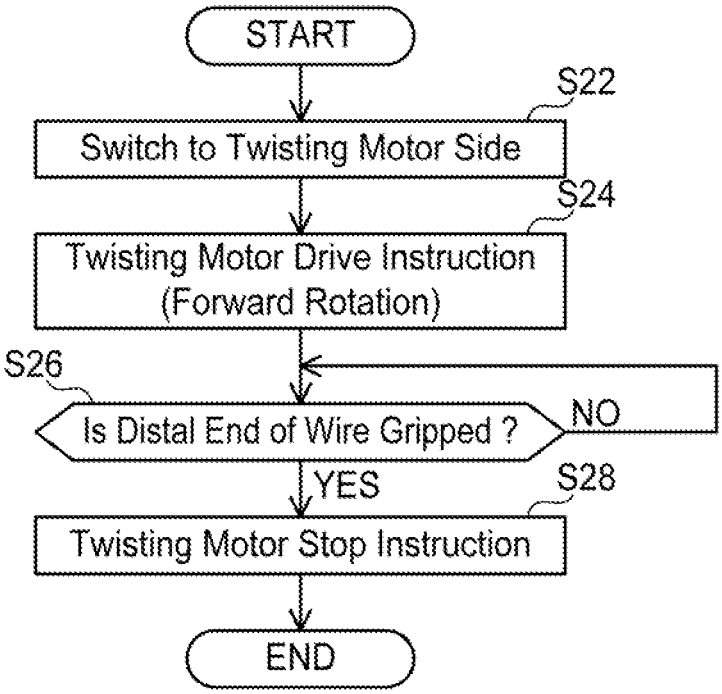
FIG. 31 is a flowchart illustrating details of a first twisting motor driving process in S4 of FIG. 29.

Referring to FIG. 31, the first twisting motor driving process will be described. In S22, the MCU 202 outputs the L potential as the switching signal SW to switch the motor control signal output switching circuit 204 and the motor rotation signal input switching circuit 206 to the twisting motor 76 side.

In S24, the MCU 202 outputs the motor control signals UH, VH, WH, UL, VL, WL to rotate the twisting motor 76 forward. As a result, the twisting motor 76 rotates forward and the distal end gripping process in which the distal end of the wire W is gripped starts.

In S26, the MCU 202 waits until the distal end of the wire W is gripped. Whether the distal end of the wire W has been gripped or not can be determined based on the detection signal of the grip detection sensor 138. When the distal end of the wire W is gripped (YES), the process proceeds to S28.

In S28, the MCU 202 outputs the short-circuit brake signal as the motor control signals UH, VH, WH, UL, VL, WL to stop the twisting motor 76. Further, the MCU 202 outputs the H potential as the brake signal BR2. Thus, the twisting motor 76 is braked. After S28, the process of FIG. 31 ends.

(Second Feed Motor Driving Process)

Figure 32:
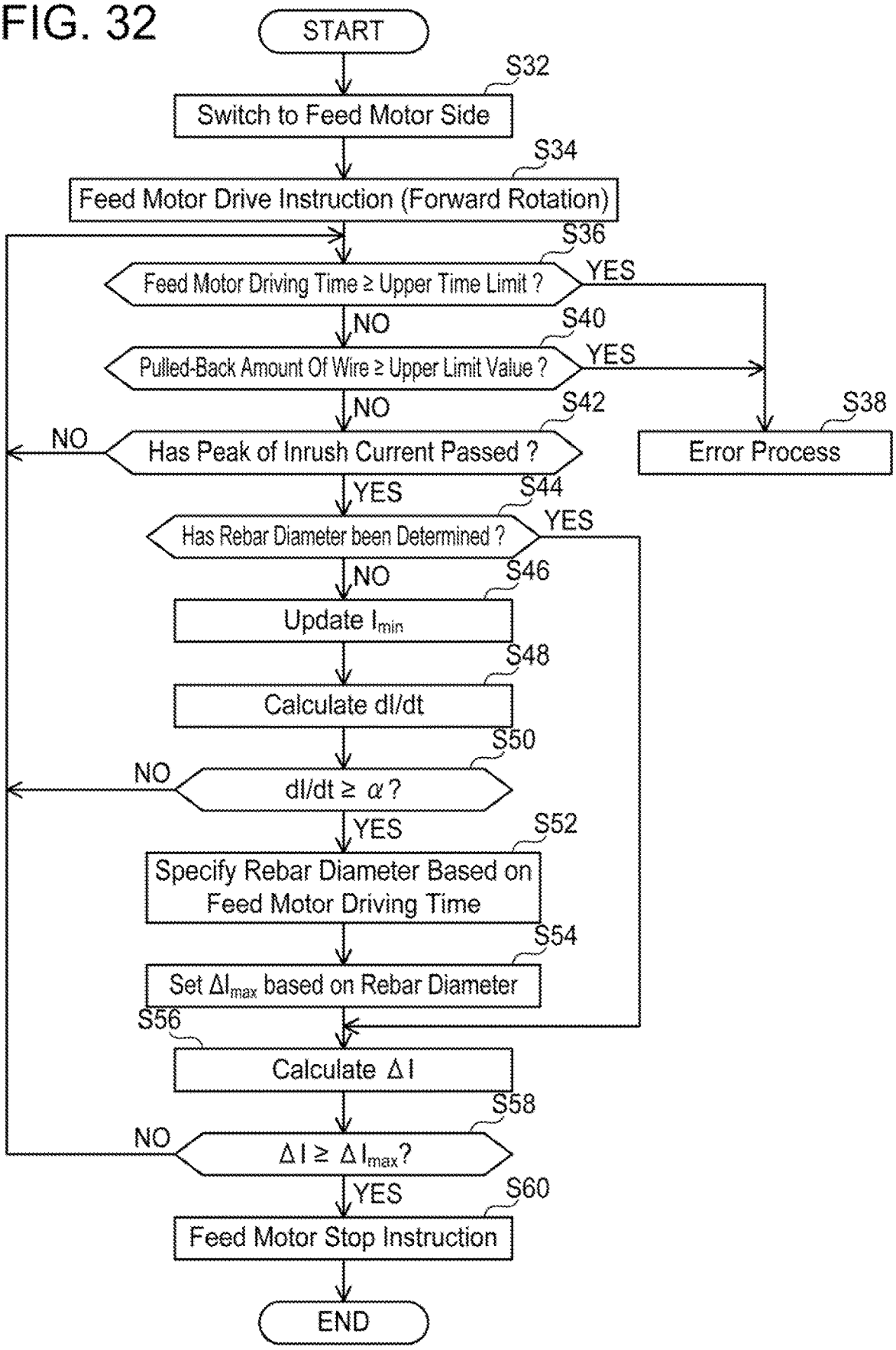
FIG. 32 is a flowchart illustrating details of a second feed motor driving process in S6 of FIG. 29.

Referring to FIG. 32, the second feed motor driving process will be described. In S32, the MCU 202 outputs the H potential as the switching signal SW to switch the motor control signal output switching circuit 204 and the motor rotation signal input switching circuit 206 to the feed motor 32 side.

In S34, the MCU 202 outputs the motor control signals UH, VH, WH, UL, VL, WL to rotate the feed motor 32 forward. As a result, the feed motor 32 rotates forward and the pulling-back process in which the wire W is pulled back starts.

In S36, the MCU 202 determines whether a time elapsed since the feed motor 32 started being driven in S34 (which may be termed a feed motor driving time, hereinafter) is no less than a predetermined upper time limit. When the feed motor driving time is equal to or greater than the upper time limit in S36 (in case of YES), the MCU 202 determines that the feed motor 32 is not rotating normally due to some sort of abnormality and performs an error process in S38. When the feed motor driving time is less than the upper limit time in S36 (in case of NO), the process proceeds to S40.

In S40, the MCU 202 determines whether a pulled-back amount of the wire W is no less than a predetermined upper limit value. The pulled-back amount of the wire W can be calculated, for example, by counting the Hall sensor signals Hu, Hv, Hw. When the pulled-back amount of the wire W is equal to or greater than the upper limit value in S40 (in case of YES), the MCU 202 determines that the distal end of the wire W is not normally gripped and performs the error process in S38. When the pulled-back amount of the wire W is less than the upper limit value in S40 (in case of NO), the process proceeds to S42.

In S42 and the following steps, the MCU 202 determines whether the pulling-back of the wire W has been completed or not, based on a history of a current value I flowing through the feed motor 32 detected by the current detection circuit 216. Hereinafter, changes in the current value I flowing through the feed motor 32 over time will be described referring to FIGS. 33 and 34.

Figure 33:
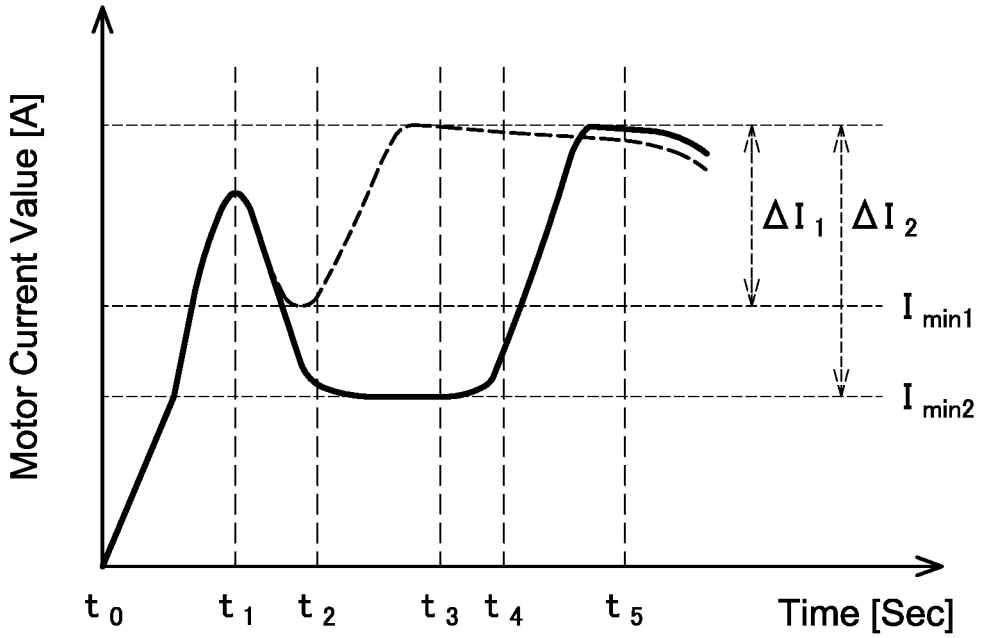
FIG. 33 is a graph showing exemplary changes over time of a current value I flowing through the feed motor 32 in a pulling-back process of the rebar tying machine 2 according to the embodiment.

In FIG. 33, a change in the current value I overtime with large-diameter rebars is indicated by a broken line, while a change in the current value I over time with small-diameter rebars is indicated by a solid line. As illustrated in FIG. 33, after the feed motor 32 starts to be driven at a time t0, the current value I increases up to a peak of inrush current at a time t1 and then gradually decreases. Then, when the wire W is started to be appressed to the rebars R, the current value I starts increasing again (at a time t2 with large-diameter rebars, and at a time t4 with small-diameter rebars). Then, when the wire W is completely appressed on the rebars R, the current value I starts decreasing again (at a time t3 with large-diameter rebars, and at a time t5 with small-diameter rebars).

Figure 34:
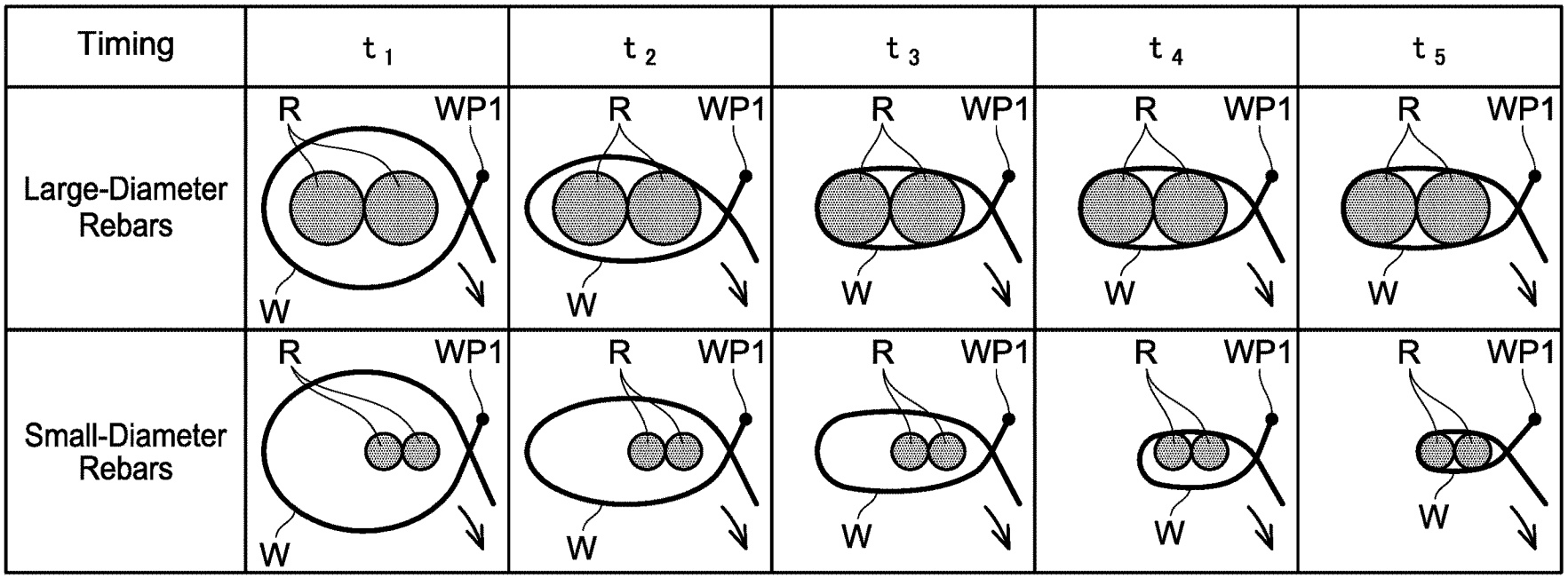
FIG. 34 is a diagram schematically illustrating relationships between a wire W and large-diameter rebars R and relationships between the wire W and small-diameter rebars R in the pulling-back process of the rebar tying machine 2 according to the embodiment.

FIG. 34 schematically illustrates relationships between the wire W and the rebars Rat the times t1, t2, t3, t4, and t5 in FIG. 33. With large-diameter rebars, the wire W starts to be appressed to the rebars R earlier (at the time t2) and the wire W is appressed completely to the rebars R earlier (at the time t3). Thus, as indicated by the broken line in FIG. 33, the current value I stops decreasing and starts increasing earlier, and then stops increasing and starts decreasing earlier. Further, a minimum value $I_{min1}$ of the current value I after the peak of the inrush current is not so small, and an increase $\Delta I_1$ in the current value I thereafter is not so large. To the contrary, as illustrated in FIG. 34, with small-diameter rebars, the wire W starts to be appressed to the rebars R later (at the time t4) and the wire W is appressed completely to the rebars R later (at the time t5). Thus, as indicated by the solid line in FIG. 33, the current value I stops decreasing and starts increasing later, and then stops increasing and starts decreasing later. Further, a minimum value $I_{min2}$ of the current value I after the peak of the inrush current is smaller and an increase $\Delta I_2$ in the current value I thereafter is larger.

In the present embodiment, the MCU 202 determines the rebar diameter based on the timing when the current value I stops decreasing and starts increasing after the peak of the inrush current, that is, based on a timing when a time rate of change dI/dt of the current value I becomes equal to or greater than a time rate of change threshold value $\alpha$. Further, the MCU 202 changes a determination condition for the completion of the pull-back based on the determined rebar diameter.

In S42 of FIG. 32, the MCU 202 determines whether the current value I has passed the peak of the inrush current or not. The MCU 202 determines that the current value I has passed the peak of the inrush current, for example, when the feed motor driving time exceeds a predetermined lower limit time. When the current value I has not passed the peak of the inrush current (in case of NO), the process returns to S36. When the current value I has passed the peak of the inrush current (in case of YES), the process proceeds to S44.

In S44, the MCU 202 determines whether the rebar diameter has been already determined or not. When the rebar diameter has not been determined yet (in case of NO), the process proceeds to S46. When the rebar diameter has been already determined (in case of YES), the process proceeds to S56.

In S46, the MCU 202 updates the minimum value $I_{min}$ of the current value I of the feed motor 32. Specifically, when the currently detected current value I is smaller than the stored minimum value $I_{min}$, the MCU 202 replaces the latter with the former.

In S48, the MCU 202 calculates a time rate of change dI/dt of the current value I of the feed motor 32.

In S50, the MCU 202 determines whether the time rate of change dI/dt is no less than the time rate of change threshold value α. The time rate of change threshold value α is a predetermined positive constant. When dI/dt is less than α (in case of NO), the process returns to S36. When dI/dt is equal to or greater than α (in case of YES), the process proceeds to S52.

In S52, the MCU 202 specifies the rebar diameter bused on the feed motor driving time. For example, when the feed motor driving time as of S52 is less than a first predetermined time, the MCU 202 determines that the rebar diameter is large. When the feed motor driving time as of S52 is equal to or greater than the first predetermined time and less than a second predetermined time which is greater than the first predetermined time, the MCU 202 determines that the rebar diameter is medium. When the feed motor driving time as of S52 is equal to or greater than the second predetermined time, the MCU 202 determines that the rebar diameter is small.

In S54, the MCU 202 sets an increase threshold value $\Delta I_{max}$ of the current value I based on the rebar diameter determined in S52. A smaller increase threshold value $\Delta I_{max}$ is set for a larger rebar diameter.

In S56, the MCU 202 calculates an increase ΔI of the current value I by subtracting the minimum value $I_{min}$ updated in S46 from the currently detected current value I.

In S58, the MCU 202 determines whether the increase ΔI calculated in S56 is no less than the increase threshold value $\Delta I_{max}$ set in S54. When the increase ΔI is less than the increase threshold value $\Delta I_{max}$ (in case of NO), the process returns to S36.

When the increase ΔI is equal to or greater than the increase threshold value $\Delta I_{max}$ in S58 (in case of YES), the MCU 202 determines that the pull-back of the wire W is completed and the process proceeds to S60.

In S60, the MCU 202 outputs the short-circuit brake signal as the motor control signals UH, VH, WH, UL, VL, WL to stop the feed motor 32. Further, the MCU 202 outputs the H potential as the brake signal BR1. As a result, the feed motor 32 is braked. After S60, the process of FIG. 32 ends.

In S52 of FIG. 32, the MCU 202 determines the rebar diameter based on the time elapsed since the feed motor 32 started to be driven in S34 (the feed motor driving time). Instead of this, for example, the MCU 202 may specify the timing when the inrush current of the feed motor 32 peaks and then determine the rebar diameter in S52 based on a time elapsed since the peak of the inrush current.

In the process of FIG. 32, regarding the current value I flowing through the feed motor 32, the MCU 202 specifies the minimum value $I_{min}$ after the peak of the inrush current and then stops the feed motor 32 when the increase ΔI from the minimum value $I_{min}$ reaches the increase threshold value $\Delta I_{max}$. Instead of this, for example, the MCU 202 may stop the feed motor 32 when a time elapsed since the time rate of change dI/dt of the current value I flowing through the feed motor 32 reached the time rate of change threshold value α in S50 reaches a time threshold value. In this case, similar to the process of FIG. 32, the stop condition for the feed motor 32 can be changed according to the rebar diameter by setting the time threshold value to a small value when the rebar diameter specified in S52 is large and setting time threshold value to a large value when the rebar diameter specified in S52 is small.

In the process of FIG. 32, the MCU 202 determines the rebar diameter and changes the stop condition of the feed motor 32, based on the history of the current value I flowing through the feed motor 32 with respect to the time t. Unlike this, the MCU 202 may determine the rebar diameter and change the stop condition of the feed motor 32, for example, based on a history of the current value I flowing through the feed motor 32 with respect to a number of rotations N of the feed motor 32. For example, the MCU 202 may calculate a rate of change dI/dN of the current value I flowing through the feed motor 32 with respect to the number of rotations N of the feed motor 32 in S48, and determine whether the calculated rate of change dI/dN has reached a rate of change threshold value β in S50.

(Second Twisting Motor Driving Process)

Figure 35:
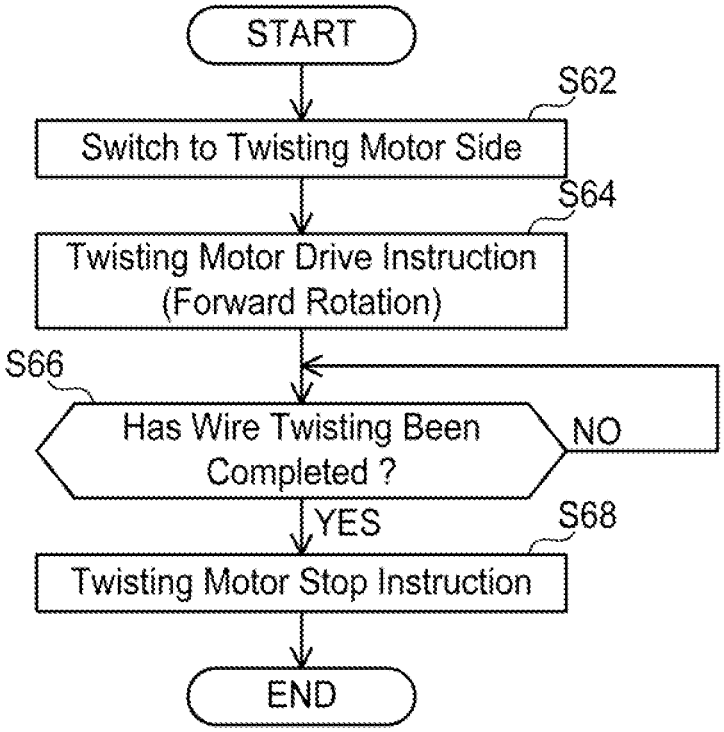
FIG. 35 is a flowchart illustrating details of a second twisting motor driving process in S8 of FIG. 29.

Referring to FIG. 35, the second twisting motor driving process will be described in detail. In S62, the MCU 202 outputs the L potential as the switching signal SW to switch the motor control signal output switching circuit 204 and the motor rotation signal input switching circuit 206 to the twisting motor 76 side.

In S64, the MCU 202 outputs the motor control signals UH, VH, WH, UL, VL, WL to rotate the twisting motor 76 forward. The twisting motor 76 thereby rotates forward, and the proximal end gripping process in which the proximal end of the wire W is gripped, the cutting process in which the wire W is cut, the pulling process in which the wire W is pulled, and the twisting process in which the wire W is twisted are sequentially performed.

In S66, the MCU 202 waits until the twisting of the wire W is completed. For example, the MCU 202 determines that the twisting of the wire W is completed when the current value detected at the current detection circuit 216 exceeds a predetermined value in accordance with a setting value of tying force for the wire W. This predetermined value may be varied depending on the rebar diameter determined in the second feed motor driving process or may be a constant value regardless of the rebar diameter. When the twisting of the wire W is completed (YES), the process proceeds to S68.

In S68, the MCU 202 outputs the short-circuit brake signal as the motor control signals UH1, VH, WH, UL, VL, WL to stop the twisting motor 76. The twisting motor 76 is thereby braked. After S68, the process of FIG. 35 ends.

(Third Twisting Motor Driving Process)

Figure 36:
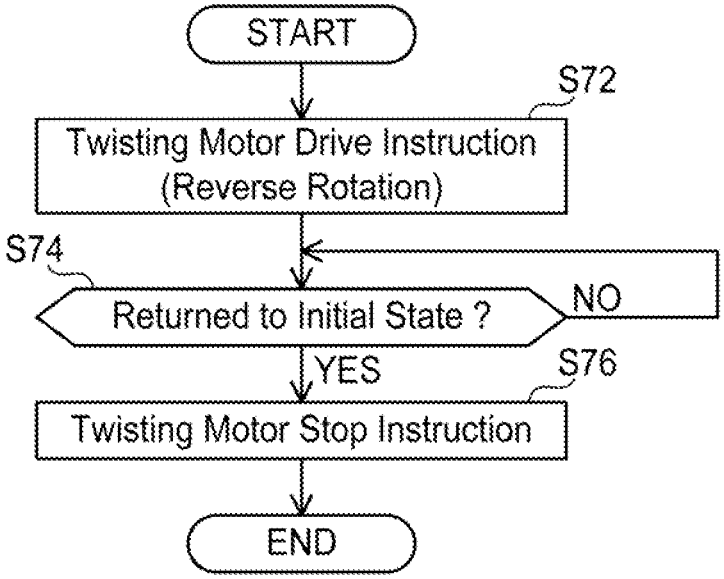
FIG. 36 is a flowchart illustrating details of a third twisting motor driving process in S10 of FIG. 29.

Referring to FIG. 36, the third twisting motor driving process will be described in detail.

In S72, the MCU 202 outputs the motor control signals UH, VH, WH, UL, VL, WL to rotate the twisting motor 76 in reverse. The twisting motor 76 thereby rotates in reverse, and the initial state returning process in which the twisting mechanism 30 returns to its initial state starts.

In S74, the MCU 202 waits until the twisting mechanism 30 returns to the initial state. Whether the twisting mechanism 30 has returned to the initial state or not can be determined based on a detection signal from the initial state detection sensor 136. When the twisting mechanism 30 has returned to the initial state (YES), the process proceeds to S76.

In S76, the MCU 202 outputs the short-circuit brake signal as the motor control signals UH, VH, WH, UL, VL, WL to stop the twisting motor 76. The twisting motor 76 is thereby braked. After S76, the process of FIG. 36 ends.

As described, in one or more embodiments, the rebar tying machine 2 comprises the feed motor 32, the current detection circuit 216 (an example of the current sensor) configured to detect the current flowing through the feed motor 32, and the MCU 202 (an example of the control unit) configured to control the operation of the feed motor 32. The rebar tying machine 2 is configured to perform the feeding-out process in which the wire W is fed out around the rebars R by driving the feed motor 32, the gripping process in which the vicinity of the distal end of the wire W is gripped, the pulling-back process in which the wire W is pulled back by driving the feed motor 32, the cutting process in which the wire W is cut, and the twisting process in which the wire W is twisted. The MCU 202 is configured to determine the diameter of the rebars R based on the history of the current value I flowing through the feed motor 32 in the pulling-back process.

In the pulling-back process above, the diameter of the loop formed by the wire W fed around the rebars R is reduced and the wire W is appressed to the rebars R. During this time, the behavior of the current value I flowing through the feed motor 32 changes at the timing when the wire W starts to be appressed to the rebars R and the timing when the wire W is completely appressed to the rebars R. As the diameter of the rebars R is larger, the timing when the wire W starts to be appressed to the rebars R and the timing when the wire W is completely appressed to the rebars R come earlier. To the contrary, as the diameter of the rebars R is smaller, the timing when the wire W starts to be appressed to the rebars R and the timing when the wire W is completely appressed to the rebars R come later. In the rebar tying machine 2 described above, the diameter of the rebars R is determined based on the history of the current value I flowing through the feed motor 32, taking advantage of the fact that the current value I flowing through the feed motor 32 in the pulling-back process exhibits different behaviors depending on the diameter of the rebars R. Thus, the rebar tying machine 2 can operate in accordance with the diameter of the rebars R without a determination mechanism for determining the diameter of the rebars R.

In one or more embodiments, the MCU 202 is configured to, in the pulling-back process, calculate the time rate of change dI/dt of the current value I flowing through the feed motor 32 after the inrush current of the feed motor 32 has peaked, and determines the diameter of the rebars R based on the timing at which the time rate of change dI/dt reaches the time rate of change threshold value $\alpha$.

In the pulling-back process, the current value I flowing through the feed motor 32 gradually decreases after the inrush current has peaked. Then, the current value I flowing through the feed motor 32 stops decreasing and starts to increase at the timing when the wire W starts to be appressed to the rebars R, and then stops increasing and starts to decrease again at the timing when the wire W is completely appressed to the rebars R. According to the configuration above, the diameter of the rebars R can be determined at the timing when the current value I flowing through the feed motor 32 stops decreasing and starts to increase after the inrush current has peaked, namely at the timing when the wire W starts to be appressed to the rebars R. Thus, the rebar tying machine 2 can perform the latter half of the pulling-back process in accordance with the determined diameter of the rebars R.

In one or more embodiments, the MCU 202 is configured to, in the pulling-back process, stop the feed motor 32 when the stop condition is satisfied. The MCU 202 is configured to change the stop condition according to the determined diameter of the rebars R.

As the diameter of the rebars R is larger, the timing when the wire W starts to be appressed to the rebars R comes earlier, and thus the feed motor 32 needs to be stopped earlier accordingly. To the contrary, as the diameter of the rebars R is smaller, the timing when the wire W is completely appressed to the rebars R comes later, and thus the feed motor 32 needs to be stopped later accordingly. According to the configuration above, the feed motor 32 can be stopped at an appropriate timing since the stop condition is changed according to the determined diameter of the rebars R.

In one or more embodiments, the MCU 202 is configured to, in the pulling-back process, specify the minimum value $I_{min}$ of the current value I flowing through the feed motor 32 after the inrush current of the feed motor 32 has peaked, and calculate the increase $\Delta I$ in the current value I flowing through the feed motor 32 from the minimum value $I_{min}$. The stop condition includes that the increase $\Delta I$ reaches the increase threshold value $\Delta I_{max}$. The MCU 202 is configured to change the increase threshold value $\Delta I_{max}$ according to the determined diameter of the rebars R.

In the pulling-back process, as the diameter of the rebars R is larger, the timing when the wire W starts to be appressed to the rebars R comes earlier, and thus the current value I flowing through the feed motor 32 does not decrease much after the inrush current has peaked. Therefore, the minimum value $I_{min}$ of the current value I flowing through the feed motor 32 after the inrush current has peaked is relatively large and the increase $\Delta I$ in the current value I therefrom until the wire W is completely appressed to the rebars R is small. To the contrary, as the diameter of the rebars R is smaller, the timing when the wire W starts to be appressed to the rebars R comes later, and thus the current value I flowing through the feed motor 32 significantly decreases after the inrush current has peaked. Therefore, the minimum value $I_{min}$ of the current value I flowing through the feed motor 32 after the inrush current has peaked is relatively small and the increase $\Delta I$ in the current value I therefrom until the wire W is completely appressed to the rebars R is large. According to the configuration above, the increase threshold value $\Delta I_{max}$ is changed according to the determined diameter of the rebars R, and thus the feed motor 32 can be stopped at an appropriate timing.

In one or more embodiments, the rebar tying machine 2 comprises the feed motor 32, the current detection circuit 216 (an example of the current sensor) configured to detect the current flowing through the feed motor 32, and the MCU 202 (an example of the control unit) configured to control the operation of the feed motor 32. The rebar tying machine 2 is configured to perform the feeding-out process in which the wire W is fed out around the rebars R by driving the feed motor 32, the gripping process in which the vicinity of the distal end of the wire W is gripped, the pulling-back process in which the wire W is pulled back by driving the feed motor 32, the cutting process in which the wire W is cut, and the twisting process in which the wire W is twisted. The MCU 202 is configured to, in the pulling-back process, stop the feed motor 32 when the stop condition is satisfied. The MCU 202 is configured to change the stop condition according to the history of the current value I flowing through the feed motor 32 in the pulling-back process.

In the rebar tying machine 2 described above, the stop condition for the feed motor 32 is changed based on the history of the current value I flowing through the feed motor 32, taking advantage of the fact that the current value I flowing through the feed motor 32 in the pulling-back process exhibits different behaviors depending on the diameter of the rebars R. Thus, the rebar tying machine 2 can operate in accordance with the diameter of the rebars R without a determination mechanism for determining the diameter of the rebars R.

In one or more embodiments, the MCU 202 is configured to, in the pulling-back process, calculate the time rate of change dI/dt of the current value I flowing through the feed motor 32 after the inrush current of the feed motor 32 has peaked, and change the stop condition according to the timing at which the time rate of change dI/dt reaches the time rate of change threshold value $\alpha$.

According to the configuration above, the stop condition for the feed motor 32 can be changed at the timing when the current value I flowing through the feed motor 32 stops decreasing and starts to increase after the inrush current has peaked, namely at the timing when the wire W starts to be appressed to the rebars R.

In one or more embodiments, the MCU 202 is configured to, in the pulling-back process, specify the minimum value $I_{min}$ of the current value I flowing through the feed motor 32 after the inrush current of the feed motor 32 has peaked, and calculate the increase $\Delta I$ in the current value I flowing through the feed motor 32 from the minimum value $I_{min}$. The stop condition includes that the increase $\Delta I$ reaches the increase threshold value $\Delta I_{max}$. The MCU 202 is configured to change the increase threshold value $\Delta I_{max}$ according to the timing at which the time rate of change dI/dt reaches the time rate of change threshold value $\alpha$.

According to the configuration above, the increase threshold value $\Delta I_{max}$ is changed according to the timing when the time rate of change dI/dt of the current value I flowing through the feed motor 32 reaches the time rate of change threshold value $\alpha$, and thus the feed motor 32 can be stopped at an appropriate timing.

What is claimed is:

1. A rebar tying machine, comprising:
- a feed motor;
- a current sensor configured to detect a current flowing through the feed motor; and
- a control unit configured to control an operation of the feed motor,
- wherein the control unit is configured to perform:
  - a feeding-out process in which a wire is fed out around rebars by driving the feed motor;
  - a gripping process in which a vicinity of a tip of the wire is gripped;
  - a pulling-back process in which the wire is pulled back by driving the feed motor;
  - a cutting process in which the wire is cut; and
  - a twisting process in which the wire is twisted, and
- the control unit is configured to determine a diameter of the rebars based on a history of a current value flowing through the feed motor in the pulling-back process.

2. The rebar tying machine according to claim 1, wherein the control unit is configured to, in the pulling-back process, calculate a time rate of change of the current value flowing through the feed motor after an inrush current of the feed motor has peaked, and determine the diameter of the rebars based on a timing at which the time rate of change reaches a time rate of change threshold value.

3. The rebar tying machine according claim 1, wherein
- the control unit is configured to, in the pulling-back process, stop the feed motor when a stop condition is satisfied, and
- the control unit is configured to change the stop condition according to the determined diameter of the rebars.

4. The rebar tying machine according to claim 3, wherein
- the control unit is configured to, in the pulling-back process, determine a minimum value of the current value flowing through the feed motor after the inrush current of the feed motor has peaked, and calculate an increase in the current value flowing through the feed motor from the minimum value,
- the stop condition includes that the increase reaches an increase threshold value, and
- the control unit is configured to change the increase threshold value according to the determined diameter of the rebars.

5. The rebar tying machine according to claim 1, wherein
- the control unit is configured to, in the pulling-back process, calculate a time rate of change of the current value flowing through the feed motor after an inrush current of the feed motor has peaked, and determine the diameter of the rebars based on a timing at which the time rate of change reaches a time rate of change threshold value,
- the control unit is configured to, in the pulling-back process, stop the feed motor when a stop condition is satisfied,
- the control unit is configured to change the stop condition according to the determined diameter of the rebars,
- the control unit is configured to, in the pulling-back process, determine a minimum value of the current value flowing through the feed motor after the inrush current of the feed motor has peaked, and calculate an increase in the current value flowing through the feed motor from the minimum value,
- the stop condition includes that the increase reaches an increase threshold value, and
- the control unit is configured to change the increase threshold value according to the determined diameter of the rebars.

6. A rebar tying machine, comprising:
- a feed motor;
- a current sensor configured to detect a current flowing through the feed motor; and
- a control unit configured to control an operation of the feed motor,
- wherein the control unit is configured to perform:
  - a feeding-out process in which a wire is fed out around rebars by driving the feed motor;
  - a gripping process in which a vicinity of a tip of the wire is gripped;
  - a pulling-back process in which the wire is pulled back by driving the feed motor;
  - a cutting process in which the wire is cut; and
  - a twisting process in which the wire is twisted, and
- the control unit is configured to, in the pulling-back process, stop the feed motor when a stop condition is satisfied, and
- the control unit is configured to change the stop condition according to a history of a current value flowing through the feed motor in the pulling-back process.

7. The rebar tying machine according to claim 6, wherein the control unit is configured to, in the pulling-back process, calculate a time rate of change of the current value flowing through the feed motor after an inrush current of the feed motor has peaked, and change the stop condition according to a timing at which the time rate of change reaches a time rate of change threshold value.

8. The rebar tying machine according to claim 7, wherein the control unit is configured to, in the pulling-back process, determine a minimum value of the current value flowing through the feed motor after the inrush current of the feed motor has peaked, and calculate an increase in the current value flowing through the feed motor from the minimum value, the stop condition includes that the increase reaches an increase threshold value, and the control unit is configured to change the increase threshold value according to the timing at which the time rate of change reaches the time rate of change threshold value.

* * * * *